United States Patent [19]

Berry et al.

[11] Patent Number: 4,825,537

[45] Date of Patent: May 2, 1989

[54] AUTOMATED CRIMPED WIRE HARNESS FABRICATOR

[75] Inventors: Stephen R. Berry, Naperville; Steven F. Wright, Glen Ellyn, both of Ill.

[73] Assignee: Molex Incorporated, Lisle, Ill.

[21] Appl. No.: 159,616

[22] Filed: Feb. 23, 1988

[51] Int. Cl.[4] ..... H01R 43/00

[52] U.S. Cl. ..... 29/747; 29/714; 29/753; 29/876; 29/884

[58] Field of Search ..... 29/857, 876, 881, 882, 29/884, 747, 753, 754, 714

[56] References Cited

U.S. PATENT DOCUMENTS 4,462,155 7/1984 Brunelle et al. ..... 29/857

*Primary Examiner*—P. W. Echols
*Assistant Examiner*—Taylor J. Ross
*Attorney, Agent, or Firm*—John W. Cornell; Louis A. Hecht

[57] ABSTRACT

An improved lead insertion apparatus for randomly inserting crimped wire leads one at a time into a multi-circuit connector includes a pair of elongate insertion jaws for longitudinally surrounding and gripping a crimp terminated wire lead. The insertion jaws are actuable by a gripper control between a first open position, a second intermediate gripping position wherein the jaws are axially slideable along the gripped wire lead and a third closed position wherein the jaws firmly grip the lead in a non-slideable manner. The jaws and their gripper control are mounted for axial movement along the wire lead into the insertion station. A drive for the jaws moves the jaws in their intermediate wire gripping position along the wire segment until a proximity sensor senses the tips of the jaws abutting the rear end of the crimp terminal. In response to the sensor the gripper control changes the jaws to their closed position on the wire prior to insertion. The insertion jaws push on the rear end of the terminal and do not rely on the column strength of the wire during insertion of the lead into the connector housing cavity. In a preferred embodiment a programmable housing index module moveable along X, Y and Z axes and a terminal guide jaw assembly are provided for use with the insertion jaws to provide an apparatus capable of randomly inserting the leads into the housing cavities in any order.

9 Claims, 23 Drawing Sheets

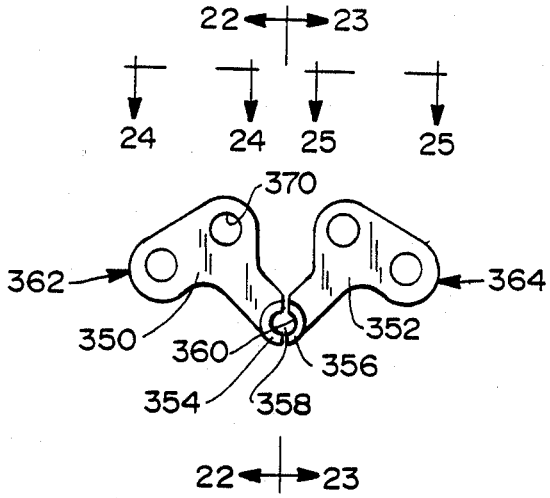
FIG.21
FIG.22
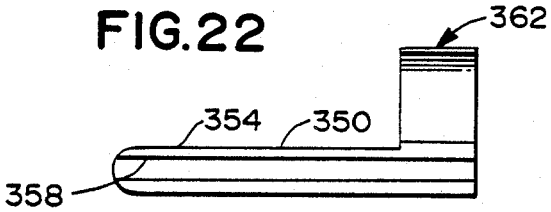
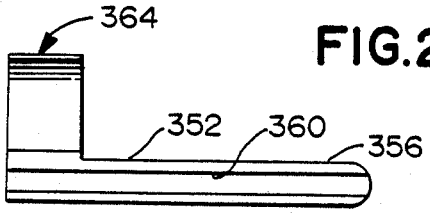
FIG.23
FIG.24
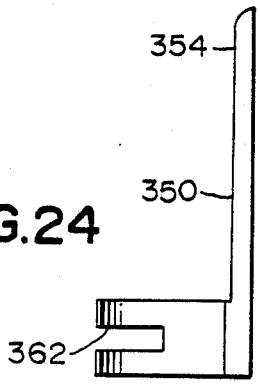
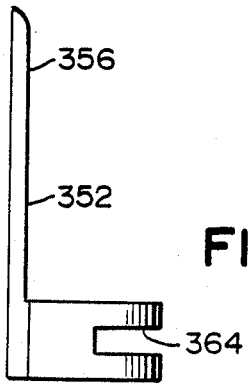
FIG.25

FIG.33
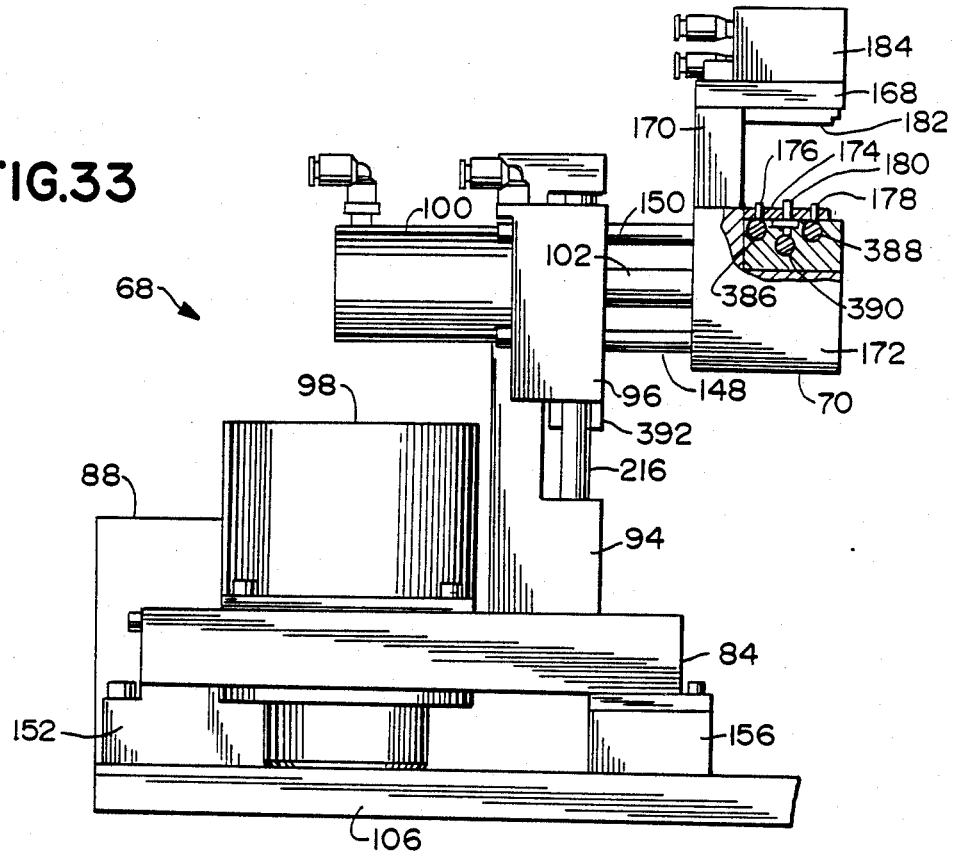
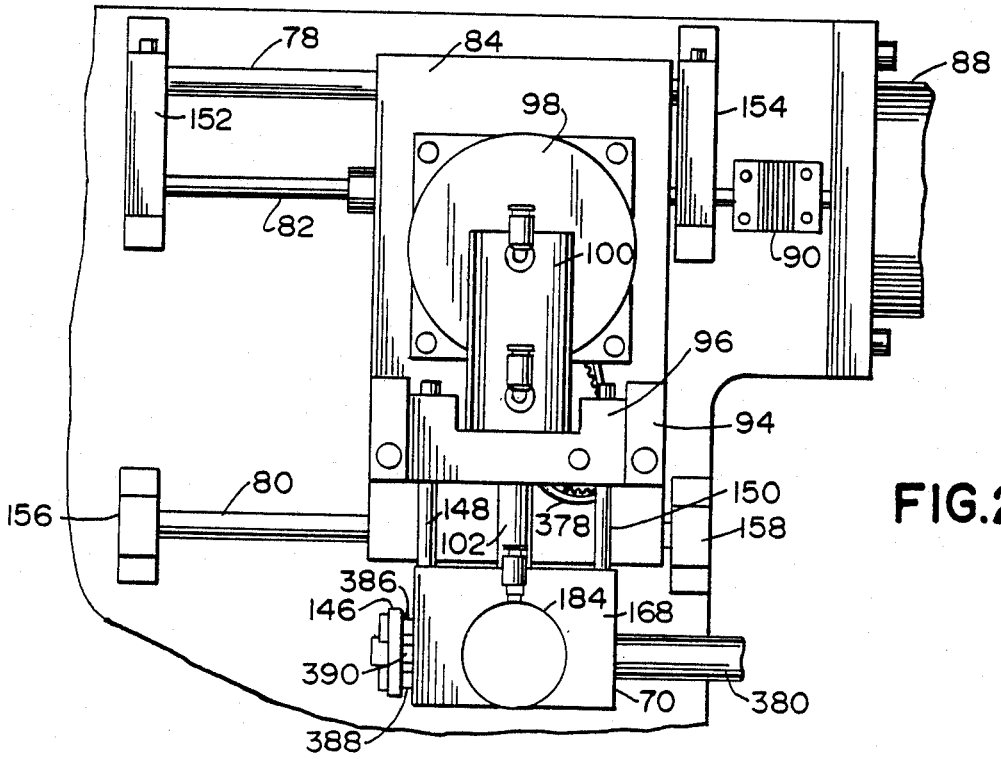
FIG.29

AUTOMATED CRIMPED WIRE HARNESS FABRICATOR

BACKGROUND OF THE INVENTION

The present invention relates to a new and improved apparatus for automatically inserting terminated wire leads into terminal-receiving cavities of a multi-circuit connector to form a wire harness. More particularly, it relates to a new and improved insertion apparatus including a lead insertion jaw assembly which does not rely on the column strength of the wire lead during insertion. The lead insertion jaw assembly may be used with an improved terminal guide assembly and an X-Y-Z programmable housing indexing module to provide a fully automated crimped wire harness fabrication machine capable of randomly inserting any gauge wire lead into the housing cavities of a multi-circuit connector in any order.

Many different kinds of wire harnesses are used for electrically interconnecting various electrical components to each other in an electronic device, component, or system. The wire harnesses typically include a plurality of insulated conductors in the form of discrete wire or cable and a plurality of electrical connectors provided at various positions along the conductor segments.

As is well known, crimp terminated leads can be inserted into a multi-circuit connector housing to provide an organized wire harness for use in interconnecting two or more electrical components. In accordance with crimp technology, the insulated conductors are stripped, typically at an end portion or at various positions along their length, to provide exposed conductor portions to which crimp terminals may be mechanically and electrically attached. The stripping and crimping operations required to provide electrically reliable crimp harnesses have become disadvantageously time consuming and expensive with the advent of insulation displacement technology.

In accordance with insulation displacement methods of wire termination, insulation displacement terminals are provided with wire receiving slots which are designed to cut through the outer insulation of the wire to make intimate gripping mechanical and electrical contact with the core conductor of the wire. Insulation displacement terminals do not require insulated wires to undergo preparatory stripping or crimping steps. Instead, the wire may simply be driven laterally of its axis into the insulation cutting slot provided in the metallic terminal.

Insulation displacement terminations are generally thought to be easier and less expensive to make and they are readily adapted to single step termination, as well as, mass termination. Customer acceptance of insulation displacement contact reliability has been achieved in some industries, such as, telecommunications and computer and peripheral equipment markets. An explosion in the development of automated tooling for use in fully automated manufacture of increasingly complex insulation displacement type wire harnesses has rapidly followed. Automatic insulation displacement wire harness fabricators capable of automatically terminating the same wire segments to dissimilar connectors, or dissimilar wire segments to a plurality of connectors, including complex cross over wire harnesses, are now known and commercially available.

Acceptance of insulation displacement termination technology for some industries, has been very difficult to achieve, particularly for those industries, such as automotive and aircraft manufacturing, wherein wire harnesses must be capable of reliably operating under high current conditions, as well as, in high vibration environments. These manufacturers have been reluctant to believe that insulation displacement contacts are reliable for their particular end-use environments. These industries still rely upon crimp termination technology to provide the secure mechanical and electrical engagement needed in high current and high vibration applications.

Accordingly, automated tooling designers and manufacturers are turning their attention to the development of new and improved fully automated crimp wire harness fabricators, for their customers who depend on crimp technology. Fully automated methods will provide these customers with the same increased production and lower installed costs, heretofore enjoyed by the insulation displacement customers.

Automated equipment and methods for fabricating crimp wire harnesses are presently known. In U.S. Pat. No. 4,308,659, for example, an automated block loading apparatus is described. The block loading apparatus includes means for conveying a plurality of terminated leads laterally their axes to a lead pick-up station. A connector housing including a plurality of terminal-receiving cavities is mounted for vertical movement in a stationary housing guide spaced from the conveyed wire leads. The apparatus described in this patent utilizes feed wheels which move into contact with a terminated wire lead and rotate in opposite directions to drive the lead through a guide tunnel into a cavity in the connector housing. The guide tunnel closely accommodates the wire during insertion. The apparatus loads a connector housing including a plurality of columns and rows of terminal receiving cavities by inserting one terminated lead at a time into one row of cavities and thereafter downwardly indexes the housing to present the next row of cavities for lead insertion. The apparatus is limited in its usefulness for preparing more complicated crimp wire harnesses because it requires that the leads be inserted one channel at a time, one row at a time, in a highly ordered manner. In addition, although the forward portion of wire lead is surrounded in a channel guide during insertion, the insertion mechanism relies on drive wheels which push the wire into the housing. This method of pushing a terminated lead into the connector housing relies upon the column strength of the wire.

Terminated wire leads adapted for press-in engagement with the terminal-receiving cavities of a connector frequently include a resilient locking tang or lance struck out from the terminal side wall or other projecting structure adapted to engage a latch recess or an inner surface of the cavity. These projecting features serve to lock the mating portions of a terminal in a proper forward position with respect to the mating face of the connector housing. The lances or other projections prevent rearward pull-out of the terminal and lead from the housing. The lance on the terminal must be deflected inwardly to permit the terminal to be slideably inserted into the housing cavity. As a result, there is a resistance to insertion including a locking tang deflection component, as well as, a sliding frictional component which must be overcome to successfully fully insert the terminated lead into the connector housing.

In some modern applications, vibration resistant crimped wire harnesses employing very fine gauge insulated wires are required. These finer-gauged leads do not possess sufficient axial rigidity, or column strength, to overcome the insertion forces required to force the terminal into a housing cavity. Accordingly, when finer gauged leads are gripped along their wire segment and driven toward the housing in an effort to insert the leads, the wires are not strong enough to overcome the insertion resistance so that they buckle and bunch against the rear end of the terminal, or the terminal is deflected out of alignment with the target cavity. Even with the aligning tunnel guide described in the above-mentioned '659 patent, an unsuccessful insertion will result if a finer gauge wire lead is employed with the apparatus because the drive mechanism relies on the column strength of the wire during terminal insertion.

Another automated apparatus for inserting terminated leads into a housing cavity is described in U.S. Pat. No. 4,607,430. This patent describes a terminal insertion module for a robot end-effector which positions pin-terminated crimped leads into a connector housing. The pin is clamped in a fixture and the wire is drawn tight by a rearward set of wire feed jaws. A cylindrical clamp with jaws at its opposed ends is closed about the tightened wire segment. An inner set of independently actuable jaws are provided within the cylinder member. The outer jaws at one end of the cylinder are clamped onto the back of the pin terminal and the rear wire tightening jaws are released. The cylindrical jaw assembly is moved toward the housing to insert the forward section of the pin terminal into a terminal receiving cavity. Thereafter, in accordance with this patent, the outer jaws are opened and the inner jaws firmly gripping the wire column are moved towards the connector housing to push the partly-inserted pin terminals to a fully inserted position in the connector housing. The apparatus and method described in this patent also rely on the column strength of the wire to achieve insertion which renders the apparatus unsuitable for use in finer gauge wire harness fabrication.

In U.S. Pat. No. 4,598,469, another apparatus and method for inserting terminated leads in a connector is described. In a socalled double pinch-push contact insertion method, two pairs of independently actuated jaws are aligned to receive a terminated lead. Forward jaws grip the terminal so that the terminal extends beyond the front end of the forward jaws and the rear jaws grip the wire. In accordance with the method described in this patent, a terminated lead is picked up in the forward jaws. The rear jaws are released and the forward jaws are advanced axially toward a connector housing to partially insert the forward end of the terminal into a connector housing cavity. Thereafter, the rear jaws are closed to maintain the wire lead in this partially inserted position. The front jaws are opened and retracted to their original position adjacent the closed rear jaws. The forward jaws are then reclosed on the wire and the rear jaws reopen. Thereafter, the front jaws are again advanced toward the connector housing thereby moving the terminal further into the connector cavity. In this manner, a terminated lead is inched in discrete steps into the housing cavity by the apparatus. This apparatus also relies on the column strength of the wire to fully insert the terminal into the housing cavity.

Still another automated wire harness fabrication machine is disclosed in U.S. Pat. No. 4,653,160. The apparatus described in this patent is a stand alone, modularized wire processing machine. The machine is capable of feeding wires from a constant supply, cutting them to a specified segment length, and loading them onto a double ended clamped conveyor means. Various wire processing modules are disposed on either side of the conveyor at various positions along its length. As described in the patent, these may include for example, wire stripping modules for stripping end segments of the wire preparatory to crimp termination and crimp terminal attachment presses for securing crimp terminals onto the stripped ends of the wire. Other wire processing modules can be provided along the length of the conveyor including a wire loop forming mechanism and wire labellers.

As described in this latter patent, a connector loading apparatus is provided at the remote end of the lead conveyor. The loading apparatus includes a housing nest which positions a multi-circuit connector housing at an insertion station within this module. A pair of insertion gripper jaws engage a portion of the wire near an end thereof from the conveyor clamps. The insertion gripper jaws are mounted in an arragement which permits the jaws to be moved in any one of three mutually perpendicular axes. In accordance with this apparatus the jaws are indexed in X, Y and Z directions toward the connector housing cavity preparatory to insertion of the wire end into a connector housing cavity. A pair of wire deflector jaws are mounted for movement with the insertion jaws. These jaws are actuable between a closed and an open position. As the insertion jaw assembly advances toward a target cavity, the closed deflector jaws contact the cavity opening of the housing. Thereafter, the deflector jaws are opened to spread or deflect the trailing ends of previously inserted wire leads away from the target cavity opening, and the insertion jaws are moved toward the connector to insert the lead into the cavity.

The insertion apparatus described in the '160 patent has a number of disadvantages. The insertion jaw assembly provides controlled movement in X, Y and Z directions to the insertion jaws to align the jaws with one housing cavity. There is no teaching or suggestion in this patent for indexing the housing to axially align one housing cavity with a gripped wire lead. Because the jaws are moved into alignment, the apparatus is limited in terms of the circuit size of connectors that may be loaded by the apparatus. As stated in the patent, a maximum of four (4) levels or rows of cavities with a maximum of sixteen (16) cavities per level is permitted. The centerline spacing between adjacent cavities must be 5 millimeters or larger. The apparatus may insert leads at random along the same row or can fill one row at a time from a lower row to the top row. The apparatus described in this patent therefore cannot randomly insert leads moving from one column, one row to a remote column and different row. It does not provide for example, for lead insertion in a first cavity followed immediately by insertion in an adjacent cavity directly below the first cavity. The apparatus also relies upon the column strength of the wire lead during insertion. There is no teaching or suggestion in this patent to grip a lead adjacent the rear end of its terminal and to support the wire column and push against the rear of the terminal in order to insert the lead into a housing cavity.

Many of the above mentioned patents describe insertion apparatus which may additionally include push test and pull test arrangements. However, they are all limited in their ability to randomly insert column to column and row to row in multicircuit connector housings and they all to some degree rely upon the column strength of the wire during insertion of the lead which renders their use unsuitable for finer gauge wire leads.

SUMMARY OF THE INVENTION

In an effort to overcome the deficiencies of the prior art devices, it is an object of the present invention to provide a new and improved fully automated wire harness fabrication machine capable of inserting crimped terminated wire leads of any wire gauge size into the cavities of the multi-circuit connector in any order.

It is another object of the present invention to provide a new and improved terminated wire lead insertion apparatus including an insertion jaw assembly which supports the wire column of the lead and pushes against the rear end of the terminal during insertion.

It is a further object of the present invention to provide a new and improved lead insertion apparatus including improved deflector means to prevent the trailing ends of previously inserted leads from interfering with a lead insertion, so that the leads can be programmably inserted into a connector housing in any order.

In accordance with the present invention, in its broadest aspects, a new and improved apparatus for inserting a terminated wire lead into a terminal receiving cavity of a multi-circuit connector at an insertion station is provided. The apparatus includes lead conveyor means having releasable clamp means for conveying wire leads laterally of their axes to a position adjacent an insertion station. A connector indexing means is provided for indexing the housing to align one terminal receiving cavity at a time in position with respect to a wire lead at the insertion station. The apparatus further includes lead insertion means having releasable clamp means for gripping the wire lead from the conveyor means and further including drive means for axially advancing the clamp means and the gripped wire lead toward the housing to fully insert the terminal into the aligned housing cavity.

In accordance with the present invention, an improved lead insertion means comprises providing as the releasable clamp means, a pair of elongate jaws each having a forward tip for longitudinally surrounding and gripping the wire lead. The elongate jaws may be controlled by an adjustable control means for actuating the jaws between a first open position, a second intermediate position wherein the jaws are axially slideable along the gripped wire lead and a third closed position wherein the jaws firmly grip the wire lead in a non-slideable manner. In addition, the improved lead insertion means includes sensing means for sensing when the front tips of the elongate jaws abut the terminal as the drive means axially advances the jaws along the wire lead toward the insertion station when in their intermediate position, whereupon the control means changes the position of the jaws from their intermediate to their closed position in response to the sensing means prior to insertion.

In accordance with this aspect of the present invention, a horizontally presented terminated lead is gripped in an intermediate or low pressure grip between a pair of elongate insertion jaws which longitudinally surround the wire lead. In their intermediate position, the insertion jaws are axially slideable along the lead segment. The drive means axially moves the insertion jaws towards the terminal on the end of the lead and towards the insertion station until the tips of the insertion jaws abut the end of the terminal. Sensing means in the form of a proximity sensor senses the position of the jaws adjacent the terminal and signals the gripper control means to close the jaws to a high pressure non-slideable grip on the wire. In this third closed position, the high pressure grip of the insertion jaws actually compresses the insulation coating surrounding the wire so that the tips of the insertion jaws abut and engage the rear portion of the terminal. Upon further movement of the drive means the gripped and supported lead is moved toward the insertion station and aligned housing cavity. The insertion jaws push on the rear portion of the terminal to insert the terminated lead into the connector housing cavity. In this manner the insertion apparatus of the present invention does not rely on the column strength of the wire during insertion.

In accordance with the preferred embodiment, the new and improved lead insertion assembly is positioned on one side of the insertion station and a connector indexing module is disposed adjacent the insertion station on a side opposite the lead insertion assembly. The connector indexing module includes a connector clamp which is moveable in three directions with respect to the insertion station and an aligned wire lead. More particularly, the connector clamp may be indexed from side to side or in an X-direction, up and down or in a Z-direction, and forward and backward or in a Y-direction, with respect to an aligned lead. The X, Y and Z movements of the clamp and connector housing are controlled by X, Y and Z drive means, respectively, which may be programmed to align one terminal-receiving cavity at a time in position at the insertion station. Moreover, the connector indexing module may be programmed to move the clamped housing along a desired path into position at the termination station. A broad range of movements can be incorporated into a single cavity-aligning step. This feature may be used to aid in deflection of previously inserted wire leads during a random insertion operation.

Also in accordance with the preferred embodiment, a pair of terminal guide jaws are provided between the insertion jaw assembly and the insertion station immediately adjacent the insertion station. The terminal guide jaws are actuable between an open and a closed position. In their closed position the terminal guide jaws define a tubular guide having an inner profiled bore adapted to slidably receive the terminated lead and to control the rotational orientation of the terminal prior to insertion. The lead insertion jaws move through the bore of the terminal guide jaws during the latter stages of their insertion stroke.

The new and improved lead insertion apparatus of the invention may also, optionally include other assemblies or modules including a wire tensioning assembly for presenting a taut, straight segment of the wire to the insertion jaws, pull test and/or push test modules for determining complete insertion of a lead into a cavity and an automated ejector module for moving a completed harness out of the housing indexing clamp and into a harness delivery track.

Other objects and advantages of the present invention will become apparent from the following detailed description of the invention with reference to the drawings in which:

BRIEF DESCRIPTION OF THE DRAWINGS

FIG. 21 is a front elevation view, partly in section, of the new and improved lead insertion jaws for use in the lead insertion apparatus of the present invention;

FIG. 22 is a side elevation view of the left lead insertion jaw taken along line 22—22 in FIG. 21;

FIG. 23 is a side elevation view of the right lead insertion jaw taken along line 23—23 in FIG. 21;

FIG. 24 is a top view of the left lead insertion jaw taken along line 24—24 in FIG. 21;

FIG. 25 is a top view of the right lead insertion jaw taken along line 25—25 in FIG. 21;

FIG. 29 is a top plan view of the new and improved programmable connector indexing module for use with the lead insertion assembly in the apparatus of the present invention;

FIG. 33 is a side sectional elevation view of the connector housing clamp and connector indexing module;

DETAILED DESCRIPTION OF THE PREFERRED EMBODIMENT

In accordance with the present invention a new and improved apparatus is provided for making a wide variety of crimped wire harnesses in a fully-automated manner. The apparatus is capable of randomly inserting a plurality of crimp terminated wire leads of any wire gauge size, one at a time, into the terminal-receiving cavities of a multi-circuit connector.

Figure 1:
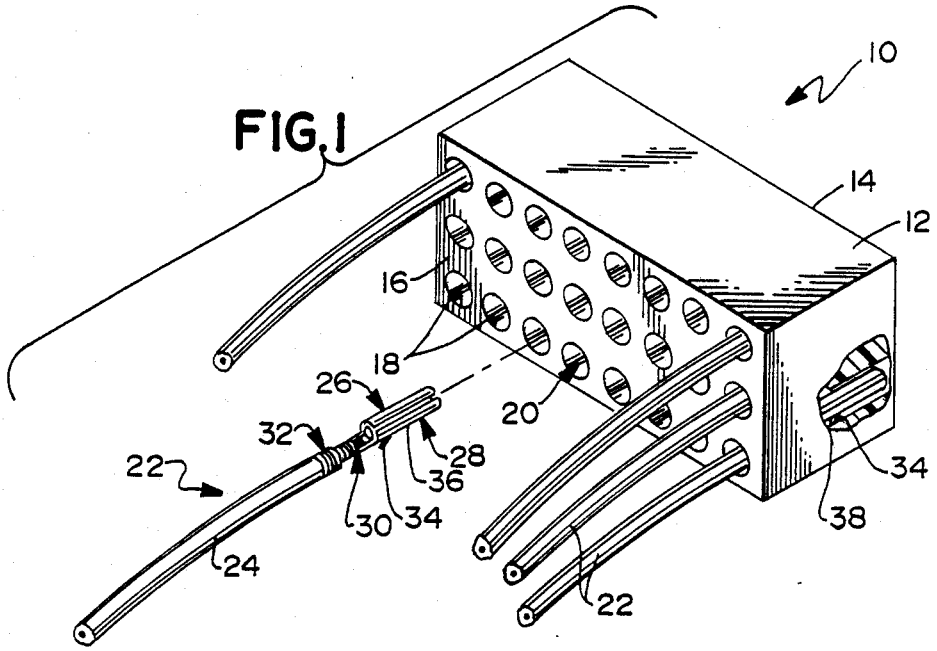
FIG. 1 is a perspective view of one end of a crimped wire harness partially cut away to show interlocking engagement between the crimped terminal and a housing cavity and further showing a crimped terminated lead exploded therefrom.

Referring now to FIG. 1, one end portion of a partially completed crimped wire harness, generally referred to by reference numeral 10, is shown. Wire harness 10 includes at least one unitary, integrally-molded dielectric housing 12 including a forward mating end 14 with a plurality of openings (not shown) and a rear conductor entry end 16 with a plurality of openings 18. A corresponding number of terminal-receiving cavities 20 extend between the front openings and rear openings 18. Each cavity 20 is adapted to slideably receive a terminated wire lead 22.

Each terminated wire lead 22 is shown to include an insulated wire segment 24 and a metallic crimp terminal 26. Crimp terminal 26 includes a forward pin-receiving mateable contact portion 28, an intermediate conductor crimp section 30, and a rearward insulation crimp section 32. Terminal 26 is firmly mechanically and electrically engaged onto the prestripped end of wire segment 24 in accordance with conventional crimp methods on commercially available crimp termination equipment. Each terminal 26 is further provided with at least one resilient locking lance 34 projecting from a sidewall 36 of the front mating contact portion 28.

Terminated wire leads 22 are loaded into multi-circuit connector housing 12 by inserting forward mating contact portion 28 through a rear opening 18 and into a cavity 20. Each cavity 20 is further provided with an interior locking recess 38 disposed adjacent front end 14. During insertion of lead 22, the locking lance 34 is deflected inwardly to permit sliding of the terminal 26 within cavity 20 until a fully inserted position is achieved. The fully inserted position of terminal 26 is achieved by forwardly advancing lead 22 into cavity 20 until the mating contact portion 28 abuts the front end 14, and locking lance 34 resiliently flexes outwardly into locking recess 38 as shown. In fully inserted position, the forward contact section 28 is appropriately aligned with respect to the openings in the front end 14 and locking lances 34 prevent rearward pull out of the terminal 26.

As can be appreciated by those skilled in this art, the opposed ends of wire segments 24 may also be terminated with crimp terminals which are also loaded into a multicircuit connector housing, such as 12, to form a double-ended wire harness. The opposed ends of wire segments 24 may be terminated and loaded into a plurality of connector housings having a smaller number of cavities, i.e., a smaller circuit size, arranged in a similar or different matrix array of columns and rows of terminal receiving cavities. The centerline spacings between the cavities of the connectors on the opposed ends may be the same or may be different, in which case, the wire segments will undergo a pitch transition between the opposed connector housings. The intermediate wire segments 24 may be crossed between opposed housings to form cross over harnesses. Many varied and complex crimp wire harnesses may be desired or required. Generally, regardless of the complexity of the harness to be made, the new and improved lead insertion apparatus of the present invention may be used to prepare the harness in a fully-automated manner.

Figure 2:
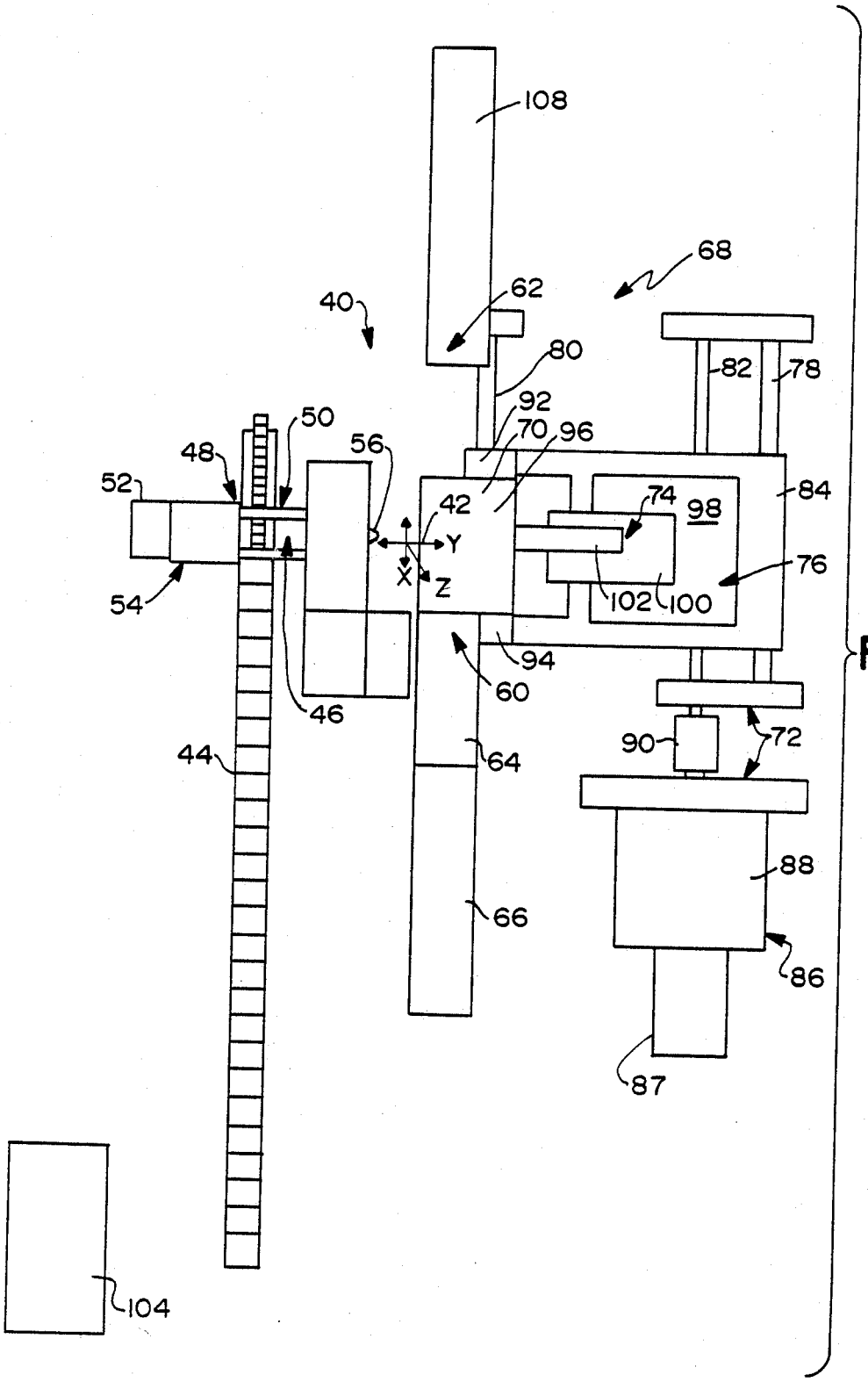
FIG. 2 is a schematic plan view of the new and improved lead insertion apparatus of the present invention.

Referring now to FIG. 2, a schematic plan view of the new and improved lead insertion apparatus of the present invention, generally referred to by reference numeral 40 is shown. The apparatus 40 includes an insertion station 42 whereat previously terminated wire leads 22 are individually inserted into the terminal receiving cavities 20 of a multi-circuit connector housing 12. Three mutually perpendicular axes, labelled X, Y and Z, intersect at the insertion station 42 as shown.

A lead conveyor assembly 44 is provided, located on one side of insertion station 42. Lead conveyor 44 includes releasable clamp means for gripping previously terminated wire leads 22 from crimp termination or wire processing equipment (not shown). Lead conveyor 44 advances spaced apart clamped wire leads 22 laterally of their axes from right to left in a direction parallel to the X-axis to a lead pick-up station 46. Lead pick-up station 46 is disposed adjacent the left end of lead conveyor 44 and is aligned with the Y-axis of insertion station 42.

A number of assemblies are associated with the lead pick up station 46. More particularly, a shot pin assembly 48 is mounted on one side of the lead conveyor 44 for positively positioning a conveyor clamp and clamped lead 22 in lead pick up station 46. A conveyor clamp opening assembly 50 is disposed on the other side of conveyor 44 opposite the shot pin assembly 48 for opening or releasing the conveyor clamp gripping a lead 22 positioned in pick up station 46. A wire tensioning assembly 52 is provided adjacent the lead pick up station 46 spaced from the shot pin assembly 48. The wire tensioning assembly 52 is also aligned with the Y-axis of the insertion station 42. Wire tensioning assembly 52 includes clamp means for gripping the trailing end of a wire segment 24 extending from a conveyor clamp at the pick-up station and means for pulling the wire segment 24 between the clamps into a taut horizontal alignment with the Y-axis of the pick-up station 46.

The new and improved insertion jaw assembly 54 is mounted above lead pick up station 46. Insertion jaw assembly 54 includes a pair of elongate insertion jaws for longitudinally surrounding and gripping a wire lead 22 with adjustable pressure and a drive means for advancing the lead insertion jaws along the Y-axis into insertion station 42.

A terminal guide jaw assembly 56 is provided along the Y-axis between lead conveyor 44 and insertion station 42. Terminal guide jaw assembly 56 includes a air of bottle-nosed jaws which may be closed to surround the terminal 26 of lead 22 to maintain the position of terminal 26 during the gripping operations of insertion jaw assembly 54 and to control the rotational orientation of the forward mating contact portion 28 of terminal 26 so that it is properly aligned for insertion into a rear opening 18 of a cavity 20. Sensing means in the form of a proximity sensor 58 is positioned along the Y-axis adjacent terminal guide jaw assembly 56 to sense the relative position of the lead insertion jaw assembly 54 along wire segment 24 with respect to the rear insulation crimp section 32 of terminal 26 and the rear end of the terminal guide jaw assembly 56.

On the opposite side of insertion station 42, a connector pick up station 60 and a harness eject station 62 are provided. Connector pick up station 60 and harness eject station 62 are both spaced rearwardly from insertion station 42 and are spaced apart in an aligned relationship parallel to the X-axis. A connector magazine feed 64 is positioned adjacent connector pick up station 60 for feeding a plurality of multi-circuit connector housings 12 one at a time to the connector pick up station 60. A housing load assembly 66 is disposed adjacent the connector magazine feed 64.

A programmable connector indexing module 68 is shown positioned generally between the connector pick-up station 60 and harness eject station 62. Connector indexing module 68 includes a connector clamp means 70 which is selectably moveable between the connector pick-up station 60, the insertion station 42 and the harness eject station 62 by means of X, Y and Z axis drive assemblies 72, 74 and 76, respectively.

More particularly, as shown in FIG. 2, X-axis drive assembly 72 includes a pair of parallel spaced guide rails 78 and 80 extending parallel to the X-axis and an X-axis drive screw 82 disposed between guide rails 78 and 80. A horizontally extending rectangular mounting platform 84 is mounted on guide rails 78 and 80 and drive screw 82 for slideable indexed translation parallel to the X-axis upon rotation of drive screw 82. Drive screw 82 is rotated in a clockwise or counterclockwise direction by means of a flexible coupling 90 attached to an X-axis motor drive 86 including a stepper motor 88 with encoder 87.

A pair of vertical mounting brackets 92, 94 extend upwardly from the front end of mounting platform 84. A vertically extending mounting platform 96 is mounted for sliding vertical movement parallel to the Z-axis between mounting bars 92 and 94. A Z-axis motor drive 98 including a similar drive screw and stepper motor with encoder arrangement is mounted on the upper surface of rectangular mounting platform 84. Z axis motor drive 98 is connected by a timing belt to a Z axis drive screw for programmably reciprocally indexing vertical mounting platform 96 parallel to the Z-axis.

The Y-axis drive assembly 74 includes an air cylinder actuator 100 mounted onto the rear side of vertical mounting platform 96. Air cylinder 100 operates a Y-axis pusher rod 102. Connector clamp means 70 is mounted on the front end of pusher rod 102. Air cylinder 100 and associated pusher rod 102 control reciprocal movements of the connector clamp 70 in the direction parallel to the Y-axis.

The independent X, Y and Z movements of the connector clamp 70 imparted by the X, Y and Z drive assemblies, can be coordinated to move a connector housing 12 positioned in clamp 70 along any defined path so that one rear opening 18 and cavity 20 are placed in alignment with the insertion station 42.

The overall sequential operation of the assemblies of the lead insertion apparatus 40 may be controlled and coordinated by a programmable system controller 104.

Figure 3:
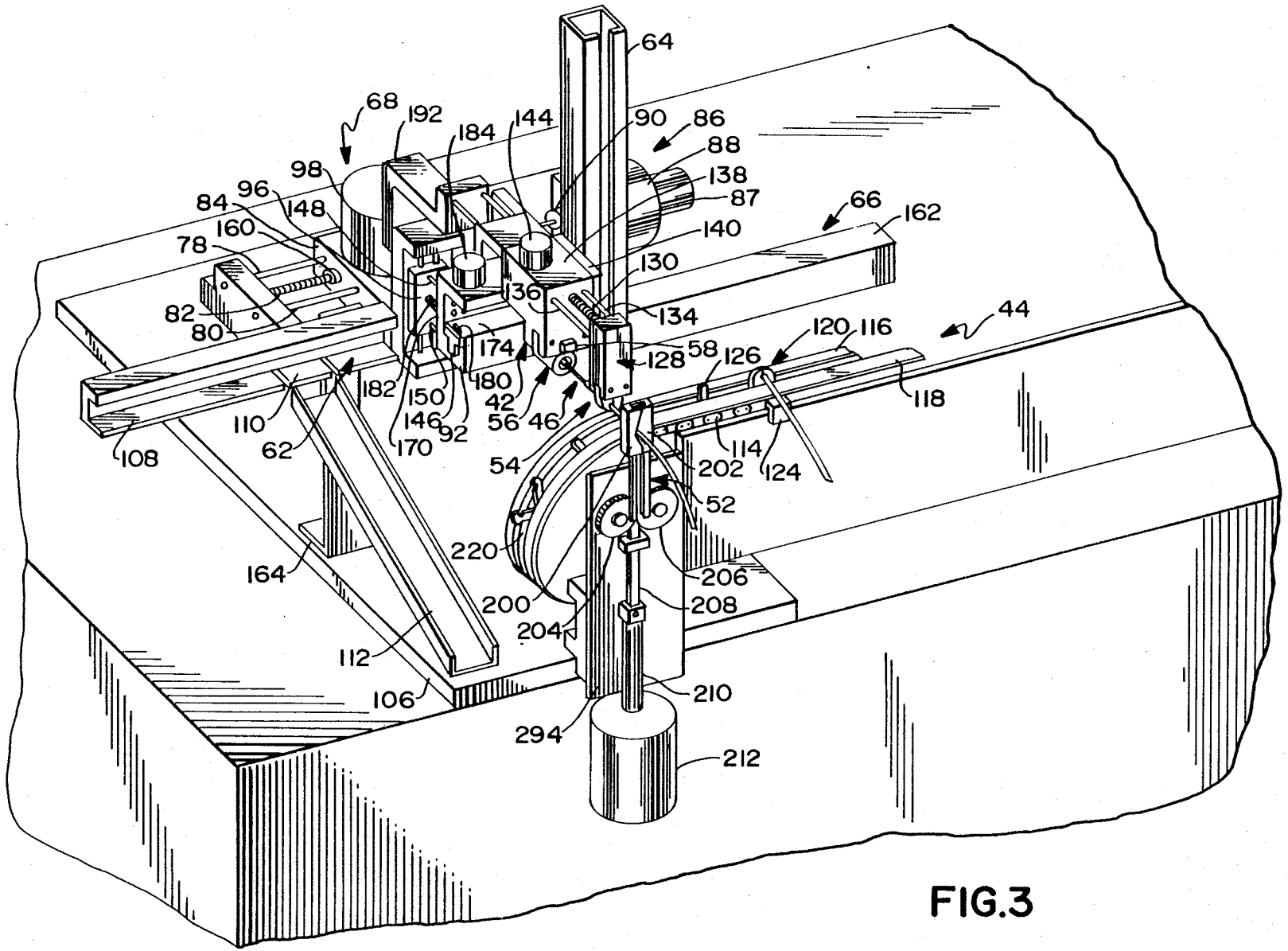
FIG. 3 is a perspective view of the new and improved lead insertion apparatus of the present invention.

FIG. 3 is a perspective view of the new and improved lead insertion apparatus 10 of the present invention. As shown in FIG. 3, apparatus 10 may be mounted onto a table member 106. The insertion station of apparatus 10 is shown at 42. On the front side of insertion station 42, the terminal guide jaw assembly 56, lead conveyor assembly 44, insertion jaw assembly 54 and the wire tensioning assembly 52 are positioned. Connector indexing module 68 and connector clamp 70 are shown on the rear side of insertion station 42. The harness eject station 62 is shown at the left side of FIG. 3 and includes a harness delivery track 108 equipped with a trap door 110 for separating out defective harnesses along reject chute 112. The top portion of connector magazine feed 64 is at the upper right hand portion of FIG. 3.

Figure 4:
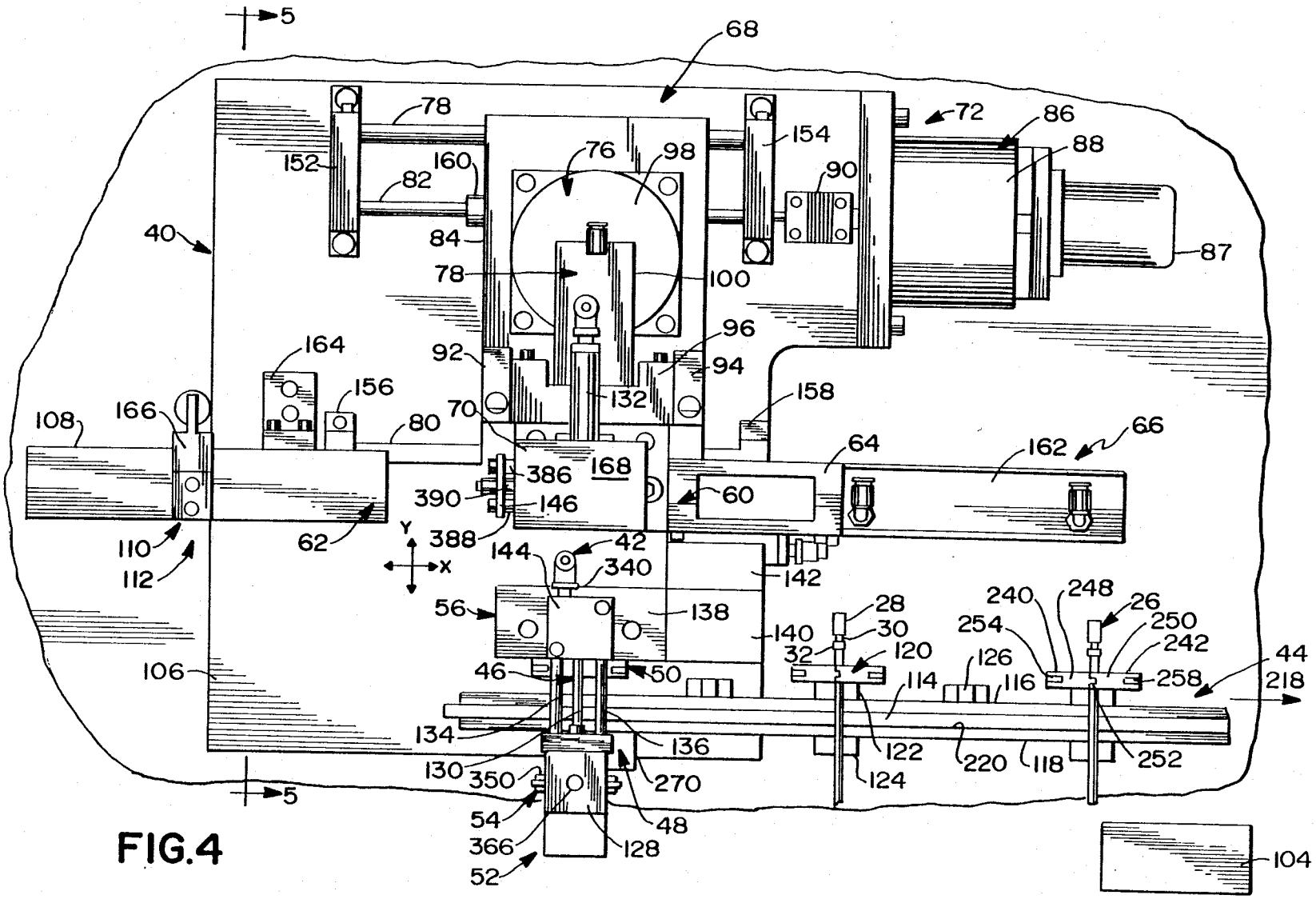
FIG. 4 is a top plan view of the new and improved lead insertion apparatus.

Referring now to FIG. 4 a top plan view of an apparatus 10 is provided in greater detail. Insertion station 42 is centrally located in the drawing. The lead pick-up station 46 is aligned with the Y-axis of insertion station 42. Lead conveyor assembly 44 extends from right to left at the lower right hand portion of the drawing.

As shown in FIG. 4, lead conveyor assembly 44 includes a chain drive belt 114 disposed between a pair of chain guide members 116 and 118. A plurality of releaseable lead conveyor clamps 120 are mounted by means of opposed pawl members 122 and 124 to the chain drive belt 114. The releasable lead conveyor clamps 120 grip the wire lead 22 at a point spaced from terminals 26. A plurality of upstanding wire deflector fingers 126 are also mounted on chain drive belt 114 between adjacent conveyor clamps 120.

The lead insertion jaw assembly 54 is mounted above the lead pick-up station 46. In the top view shown in FIG. 4, lead insertion assembly 54 includes a gripper control means 128 mounted on a plate on the end of a drive rod 130. Drive rod 130 is in turn actuated by a lead insertion drive air cylinder 132. Air cylinder 132 and drive rod provide a drive means which is effective to move the gripper control means 128 and insertion jaw assembly 54 into and out of insertion station 42 along the Y axis. A pair of guide rails 134 and 136 also extend from gripper control means 128 to provide stable slidable actuation of the gripper control means 128 in the Y-axis direction.

A picture frame mounting bracket 138 for housing the lead insertion drive assembly 130 and 132 and terminal guide jaw assembly 56 is cantilever mounted above lead pick-up station 46 from vertical mounting arms 140 and 142. Mounted atop picture frame bracket 138 is provided the actuator 184 for the terminal guide jaw assembly 56 which extends from the underside of the picture frame bracket 138.

Connector indexing module 68 is disposed on the opposite side of insertion station 42. Extending from the left hand side of connector clamp 70 is the connector clamp end plate 146. The Y-axis drive rod 102 extends rearwardly of connector clamp 70 as do a pair of spaced Y-axis guide rails 148 and 150. Drive rod 102 and guide rails 148 and 150 extend through vertical mounting platform member 96 which is disposed between the upstanding vertical mounting brackets 92 and 94. The air cylinder actuator 100 for the Y-axis drive rod 102 is shown mounted for movement with the vertical mounting platform 96.

The vertical mounting platform 96 travels parallel to the Z-axis of the insertion station 42 and is driven by the Z-axis drive motor 98 which is mounted on top of translating horizontal platform 84. Horizontal platform 84 rides on spaced apart guide rails 78 and 80 and on drive screw 82 as shown. Guide rail 78 and drive screw 82 are mounted to the table 106 by means of mounting brackets 152 and 154 as shown. The X-axis drive screw 82 is driven by the X-axis stepper motor 88 with encoder 90, shown at the upper right hand portion of the drawing. The front X-axis guide rail 80 is also mounted between a pair of opposed mounting brackets 156 and 158, as shown. A stationary threaded drive bushing 160 is shown extending from the left hand side of platform 84 for riding along drive screw 82 upon rotation thereof by the drive motor assembly 72.

Disposed a the right hand side of the insertion station 42 the connector pick-up station 60 is indicated underneath the connector housing magazine feed 64. The housing load assembly 66 including the air cylinder actuator 162 for moving a pusher rod (not shown) is positioned adjacent magazine feed 64.

Harness eject station 62 is located on the left hand side of insertion station 42 attached to harness delivery track 108. The harness delivery track 108 is mounted above table member 106 means of the L-shaped mounting rod 164 as shown. A trap door actuator 166 for ejecting defective harnesses after testing is also shown.

Figure 5:
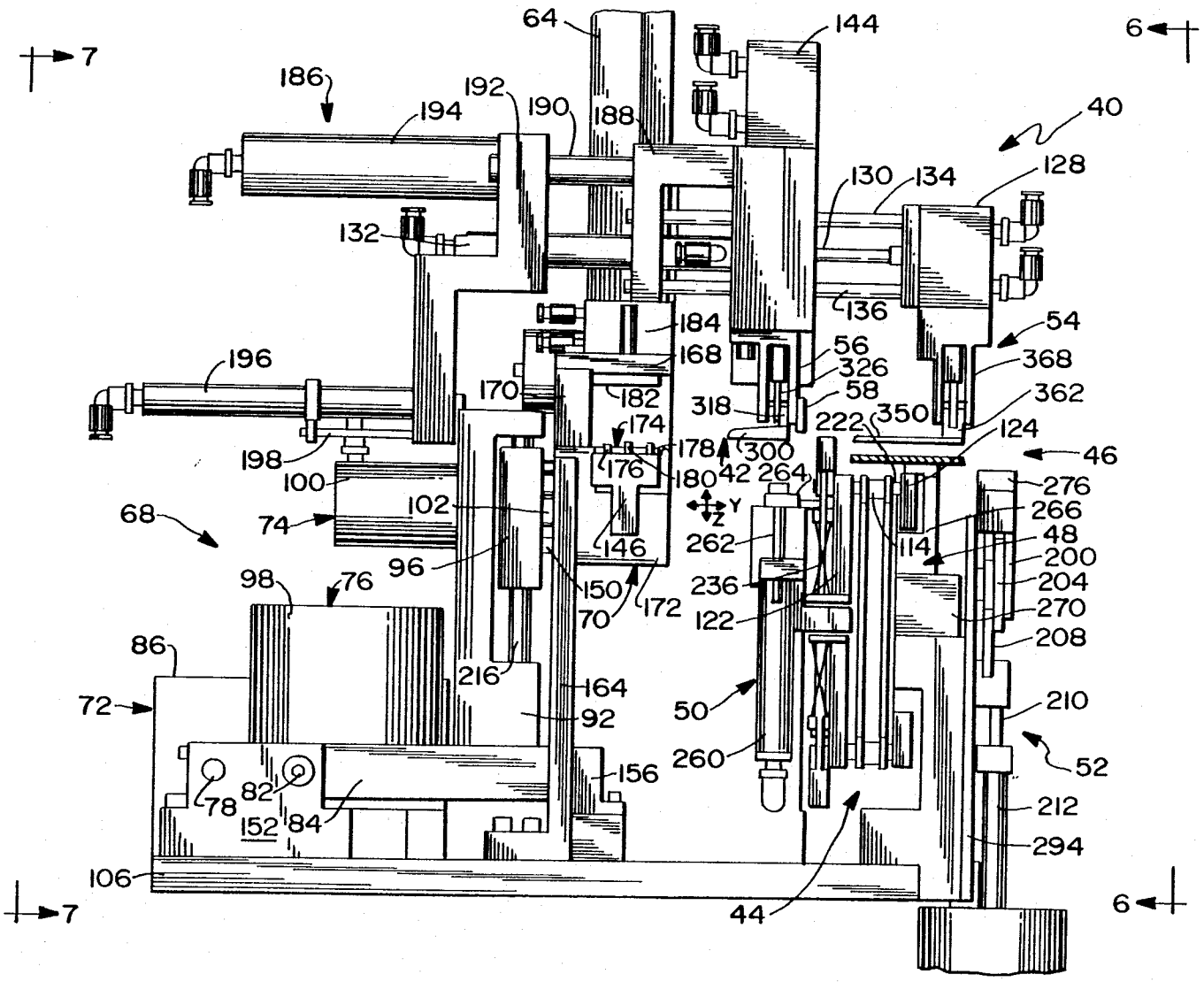
FIG. 5 is a side elevation view of the new and improved lead insertion apparatus taken along lines 5—5 in FIG. 4.

Referring now to FIG. 5 a side elevation view of the insertion station of the apparatus 10 is shown. As shown therein, terminal guide jaw assembly 56 depends from the lower end of picture frame mounting bracket 138. The lead insertion jaw assembly 54 extends from the underside of the gripper control means 128. The lead conveyor assembly 44 with conveyor clamp 120 mounting pawl members 122 and 124, and chain drive belt 114 are disposed at the lead pick-up station 46 below the terminal guide jaw assembly 56 and lead insertion jaw assembly 54. A clamp opening assembly 50 is positioned on the left side of the conveyor assembly 44. The shot pin assembly 48 is shown mounted on the right hand side of chain drive belt 114. Spaced to the right of lead conveyor assembly 44, the wire tensioning assembly 52 is shown.

Connector clamp 70 is shown on the left side of insertion station 42. Connector clamp 70 is of a generally C-shaped configuration including a top wall 168, a rear wall 170 and enlarged base portion 172 having an upper connector receiving surface 174. Connector clamp end plate 146 is seen to have a generally T-shaped configuration. A pair of spaced connector eject pawls 176 and 178 and a connector stop pawl 180 project upwardly from surface 174 of base member 172. A moveable clamp member 182 extends adjacent top wall 48. Clamp member 182 is moved downwardly toward base member 172 by means of a rod (not shown) which is driven by air cylinder 184 mounted atop top wall 168 to fix the position of a connector 12 within clamp 70. A test probe aperture 382 is shown extending through rear wall 170 of connector clamp 70. Base portion 172 is disposed on the front ends of Y-axis drive rod 102.

Drive rod 102 extends through vertical platform member 96 to Y-axis air cylinder actuator 100. Vertical mounting brackets 92 and 94 are shown to have a C-shaped configuration and Z-axis guide rail 186 and 188 are mounted thereto. The L-shaped mounting post 164 is shown in the foreground which is adapted to mount and position the harness delivery track 108 and associated structures.

In the upper left hand portion of FIG. 5, an optional push test probe assembly is shown. An L-shaped mounting projection 188 extends adjacent one side of picture frame bracket 138, with a cylindrical drive rail 190 extending leftwardly therefrom and permanently mounted to projection 188. A Z-shaped mounting bracket 192 is mounted for movement along drive rail 190 by means of air cylinder 194. Air cylinder 194 moves the Z-shaped bracket 192 in the Y-axis direction. Mounted to the lower end of Z-bracket 192 is a probe actuation cylinder 196 adapted to actuate a pin probe 198 to an extended position through the apertured rear wall 170 of clamp 70 into a front opening in a clamped connector housing 12.

Figure 6:
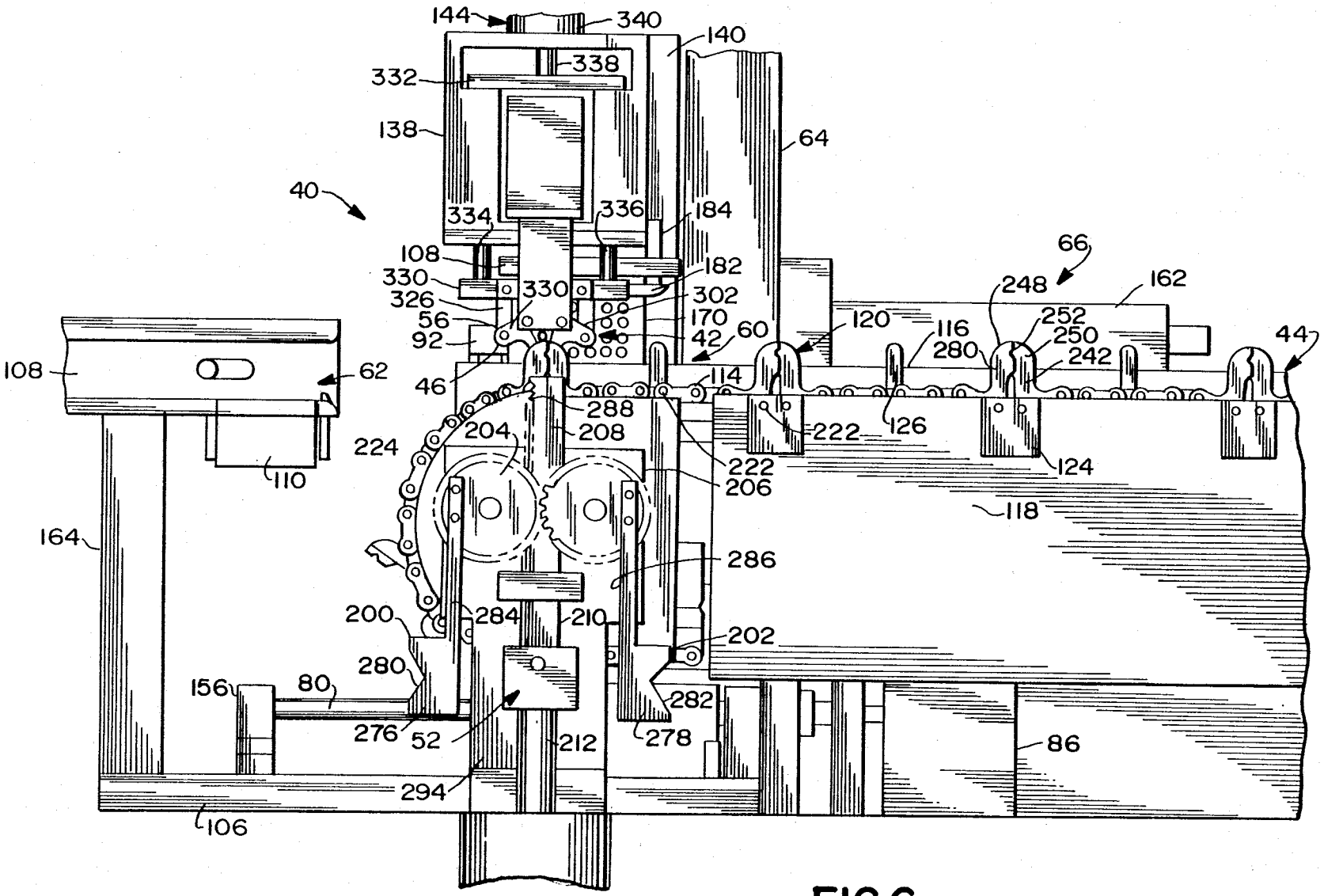
FIG. 6 is a front elevation view of the new and improved lead insertion apparatus taken along line 6—6 in FIG. 5.

Referring now to FIG. 6, a front elevation view of the lead pick-up station 46 and aligned insertion station 42 is shown. Wire tensioning assembly 52 is shown to include a pair of elongate wire tensioning jaws 200 and 202 mounted for rotational movement on pinion members 204 and 206, respectively. Pinion members 204 and 206 are driven by a rack 208 which is in turn connected to a drive rod 210 connected to an air cylinder actuator 212.

A pair of conveyor clamps 120 are positioned in the lead pick-up station 46. Terminal guide jaw assembly 56 is disposed behind conveyor clamp 120. Apertured rear wall 170 of the connector clamp 70 is shown.

To the right hand side of the insertion station 42, the connector magazine feed 64 can be seen as well as the picture frame mounting bracket 138 for the terminal guide assembly 56 and the lead insertion jaw assembly drive.

The harness eject station 62 is shown the left of insertion station 42 and includes trap door 110 for ejecting those harnesses which fail a push-or-pull test or an electrical continuity test.

Figure 7:
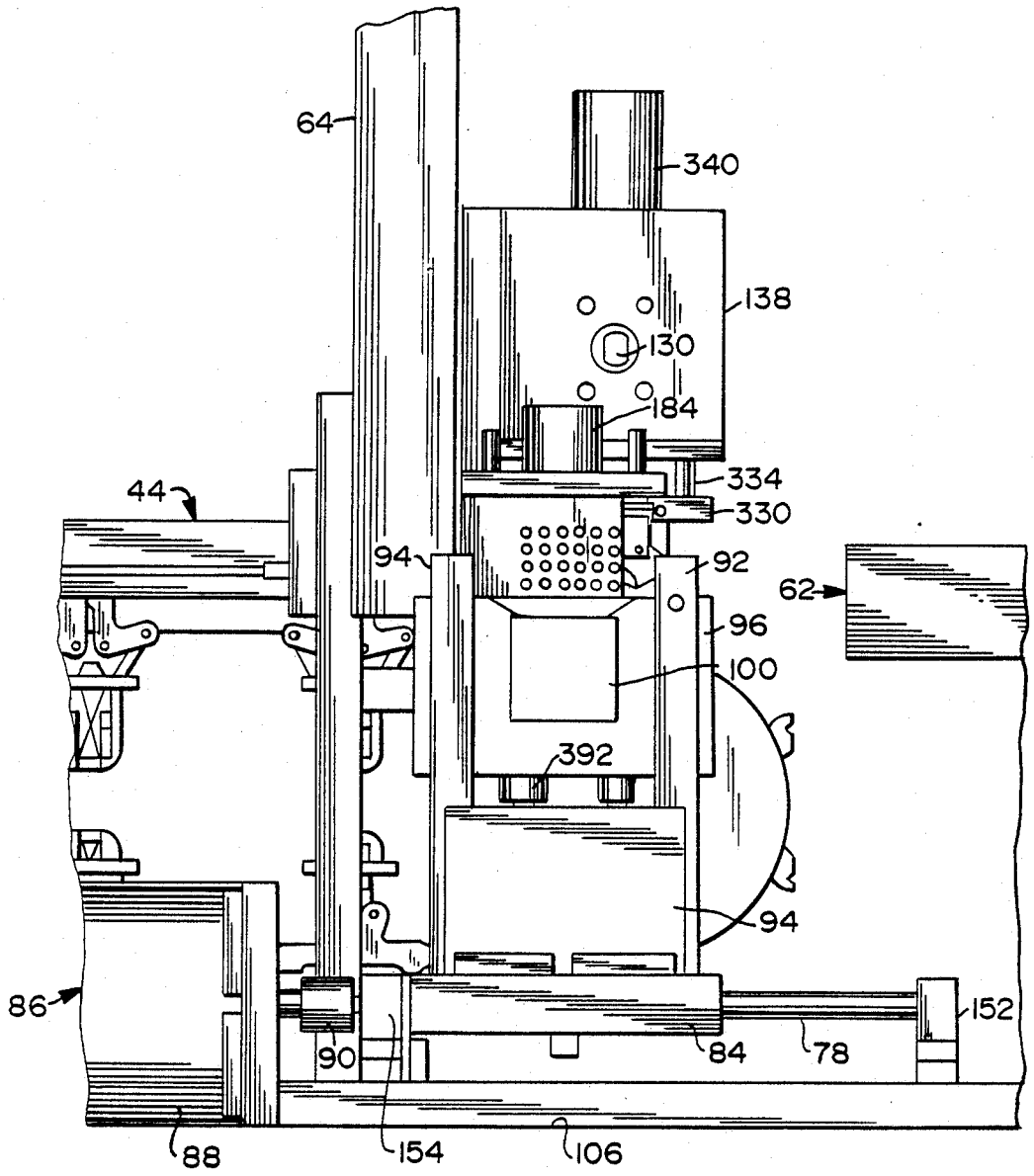
FIG. 7 is a rear elevation view of the new and improved lead insertion apparatus taken along line 7—7 of FIG. 5.

Referring now to FIG. 7, a rear end view of the insertion station 42 of apparatus 10 is shown. The rear wall 170 of conveyor clamp 70 includes a plurality of test probe apertures 382 disposed in registration with the forward openings in the mating face of a clamped connector housing 12. Mounted atop the connector clamp 70 is the air cylinder actuator 184 for moving the clamping member 182 of the connector clamp 70 into a lowered position to grip a housing 12. The magazine feed 64 is shown on the left side of the connector clamp 70

The drive assembly for the Z-axis is shown more particularly in FIG. 7 to include a drive screw 214 and guiding rail 216 arrangement disposed between the vertical mounting brackets 92 and 94 as shown. The air cylinder 100 for the Y-axis movement extends above the Z-axis drive motor 98. Horizontal rectangular platform 84 is laterally translatable by means of the X-axis drive motor 88 and drive screw 82 arrangement on the guide rails 78 and 80.

The various subassemblies in the new and improved lead insertion apparatus 10 of the preferred embodiment will now be described in greater detail.

A. Lead Conveyor Assembly

Figure 8:
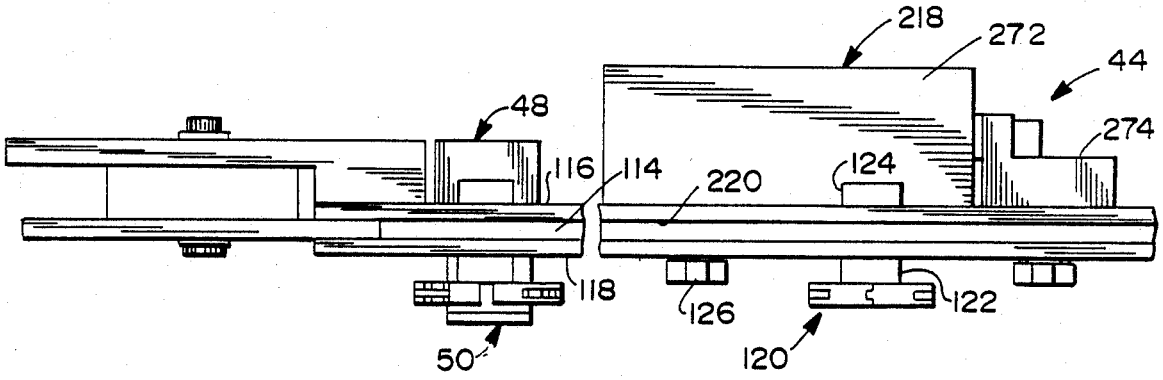
FIG. 8 is a top plan view of the lead conveyor assembly for use in the new and improved lead insertion apparatus of the present invention.

The details of the lead conveyor assembly 44 are shown in FIGS. 8–11. Referring to FIG. 8, a top plan view of the opposed ends of the lead conveyor 44 are shown. The left hand portion illustrates the lead conveyor 44 at the lead pick up station 46 and the right hand portion illustrates the conveyor drive 218 located at the opposed end. Lead conveyor assembly 44 includes a continuous chain conveyor belt 114 disposed in a chain receiving groove 220 formed by chain guides 116 and 118. Chain conveyor 114 travels along a vertically oriented closed oval loop. A pair of opposed roller guides including a front roller guide 222 and a rear roller guide (not shown) are provided at the opposed ends of the conveyor 114 to gradually reverse the direction of the chain 114. One of the rollers may be adjustable to properly adjust the tension on the chain 114. A plurality of releaseable clamp members 120 are spaced along the chain member 114. A plurality of wire deflecting fingers 126 are also provided at spaced locations on the chain 114 between adjacent clamp members 120. Clamp members 120 are mounted onto an elongate rectangular pawl member 122 which is mounted by means of rivets 222, 222 through the circular chain links 224 and through an opposing shorter rectangular pawl 124. Wire deflecting fingers 126 are also mounted to the chain links 224 by means of rivets 222 as shown.

Figure 9:
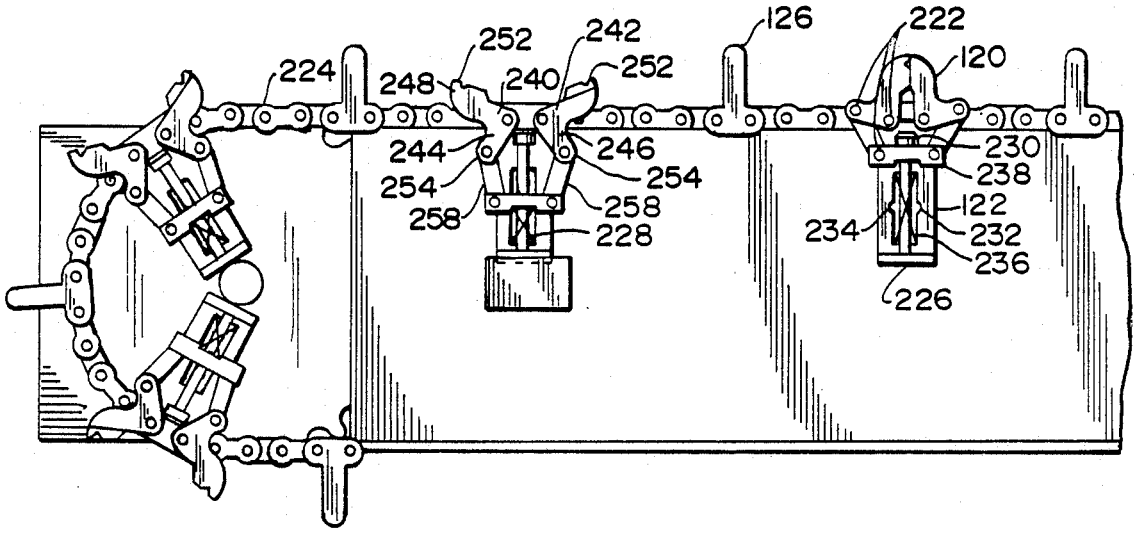
FIG. 9 is a side view of the lead conveyor assembly shown in FIG. 8.
Figure 11:
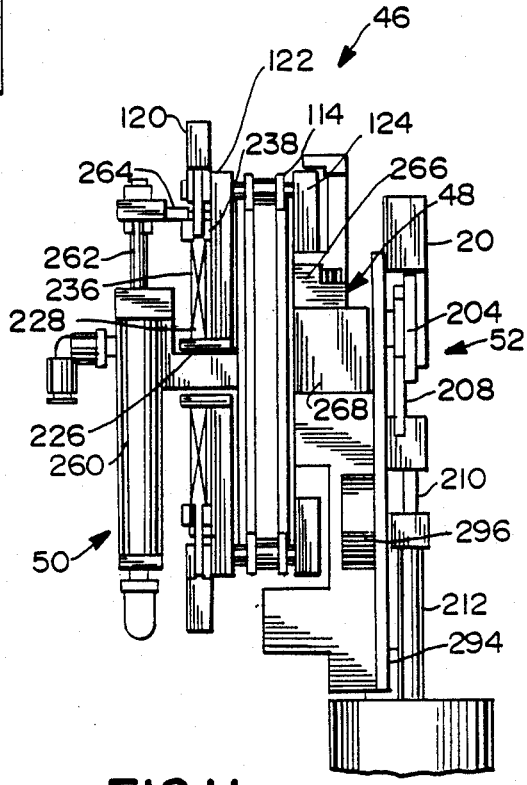
FIG. 11 is a side sectional elevation view of the pick up station of the lead conveyor assembly.

Referring now to FIGS. 9 and 11, the structure of the releaseable clamp members 120 is more clearly explained. Elongate rectangular pawl members 122 include a pair of spaced mounting apertures adjacent an upper end thereof through which rivets 222 extend. A perpendicular base projection 226 extends from one side of the bottom of pawl member 122. A spring retention pin 228 with a spring retainer nut 230 extends upwardly from base projection 226. The center portion of pawl 122 includes a rectangular cut out 232 provided with a pair of opposed semi-circular catch depressions 234. A helical coil spring 236 and a spring plate member 238 are mounted for sliding movement on pin 228 and are retained thereon by retainer nut 230. A pair of rearwardly extending cylindrical catch members (not shown) extending from spring plate member 238 extend into rectangular cut out 232 on opposed sides of pin 238. The catch members engage the semi-circular catch depressions 234 when spring plate member 238 is pushed downwardly toward base projection 226 compressing spring 236 to retain the clamps 120 in an open position.

Conveyor clamps 120 are each defined by a pair of opposed clamp arms 240, 242 having a generally L-shaped configuration each including a base portion 244 and 246 and a rounded clamping portion 248 and 250. A pair of opposed V-shaped notches 252 are provided at the rounded free ends of clamping portions 248, 250 for gripping the insulated wire segments 24 of leads 22. The clamps are rotatably mounted to rectangular pawls 122 by means of rivets 222 which extend through mounting apertures provided in base portions 244, 246. The opposed free ends of base portions 244, 246 include a yoke formation 254 and a pair of registering apertures 256 extending therethrough adapted to pivotably connect one end of linker arms 258 to the free-ends of the base portions 244, 246. Rivets 222 secures linker arms 258 to base portions 244, 246. The opposed ends of linker arms 258 are each pivotably mounted by means of a similar yoke and rivet arrangement to spring plate member 238. As shown in FIG. 9, coil spring 236 pushes spring plate 238 upwardly which is effective to rotate clamp arms 240, 242 to their normally closed position.

Referring now to FIGS. 8 and 11, the conveyor clamp opening assembly 50, is shown mounted along side the lead conveyor 44 at the lead pickup station 46. The clamp opening assembly 50 includes an air cylinder actuator 260, an actuator rod 262 and a cantilevered clamp opening pawl 260 mounted onto the free end of the actuator rod 262. Air cylinder 260 is effective to move actuator rod 262 between a raised or extended position as shown in FIG. 11 and a lowered position (shown in FIG. 43). In the extended or raised position shown in FIG. 11, the opening pawl member 264 is positioned to engage an upper surface of the spring plate member 238. In the lowered or retracted position, the air cylinder 260 has actuated rod 262 downwardly carrying with it the opener pawl 264 which pushes the spring plate 238 downwardly against the action of the coil spring 236. Downward actuation of opener pawl 264 is effective to move spring plate 238 and linker arms 58 downward, thereby rotating rounded clamping portions 248 and 250 of the clamp arms 240, 242 outwardly to an open position. In this lowered position, the rearwardly extending cylindrical catch members on spring plate member 238 engage the catch depressions 234 in cut out 232 in elongate pawl member 122 to retain the conveyor clamps 120 in their open position. The open position of the conveyor clamps 120 is shown at the left hand portion of FIG. 9.

A second smaller rectangular pawl 124 is mounted on the other side of the chain member 114 as shown in FIG. 8. Pawl 124 is provided for engagement by a shot pin assembly 48. As shown in FIGS. 8 and 11, shot pin assembly 48 includes an L-shaped pawl member 266 which travels on a rod 268 actuated by a shot pin air cylinder 270. As shown in FIG. 11, the shot pin pawl 266 may be moved upwardly to engage an approaching rectangular pawl member 124 to stop forward advance chain conveyor 114 in positive position at the lead pick up station 46.

Referring again to FIG. 8 drive mechanism 218 for advancing the lead chain conveyor 114 toward the lead pick-up station 46 is shown at the right hand portion of the drawing to include a chain drive air cylinder actuator 272 which carries a rod mounted rotatable spring loaded drive pawl 274. Chain drive mechanism 218 is shown in a retracted position wherein the drive pawl member 274 is positioned adjacent the cylinder housing 272. In an extended position, spring loaded drive pawl 274 is extended rightwardly. As drive pawl 274 moves to its extended position it rotates and slides beneath rectangular conveyor chain pawls 124. At the end of its extension stroke, drive pawl 274 is spring loaded to rotate to a catch position. In this extended position, the spring loaded pawl member 274 will engage rectangular pawl 122 on the chain 114. Leftward actuation of drive pawl 274 towards drive air cylinder 272 pushes against pawl 124 and advances the chain conveyor 114 leftward. In this manner, terminated wire leads 22 gripped within conveyor clamps 120 are advanced in discrete steps toward the lead pick up station 46.

B. The Wire Tensioning Assembly

Figure 10:
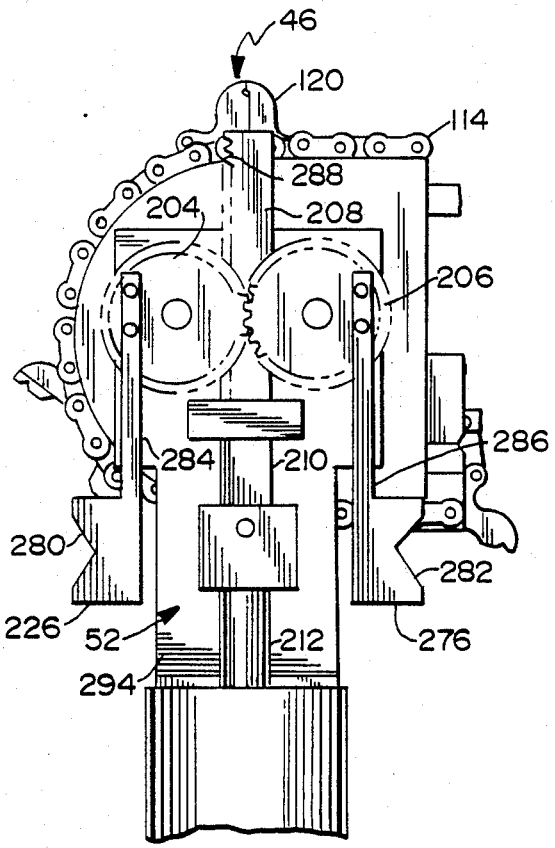
FIG. 10 is a front view of the lead pick-up station along the lead conveyor assembly.
Figure 12:
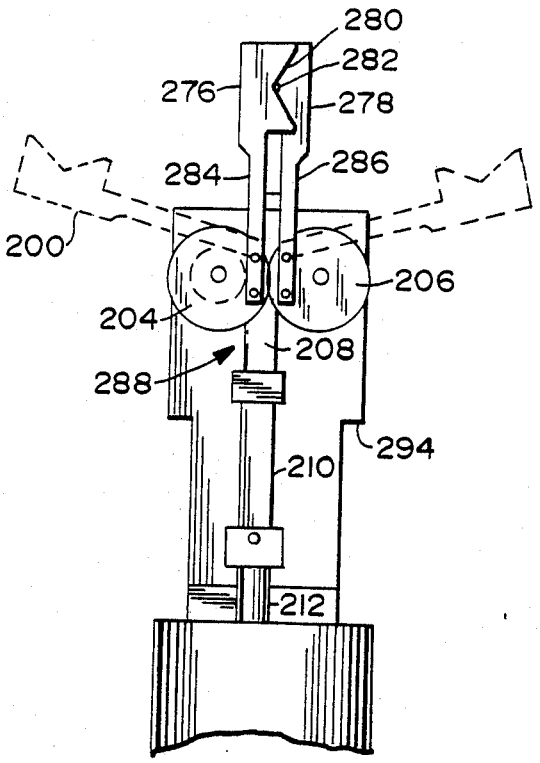
FIG. 12 is a front elevation view of the wire tensioning assembly for use in the new and improved lead insertion apparatus of this invention with the wire tensioning jaws shown in their raised wire gripping position.
Figure 13:
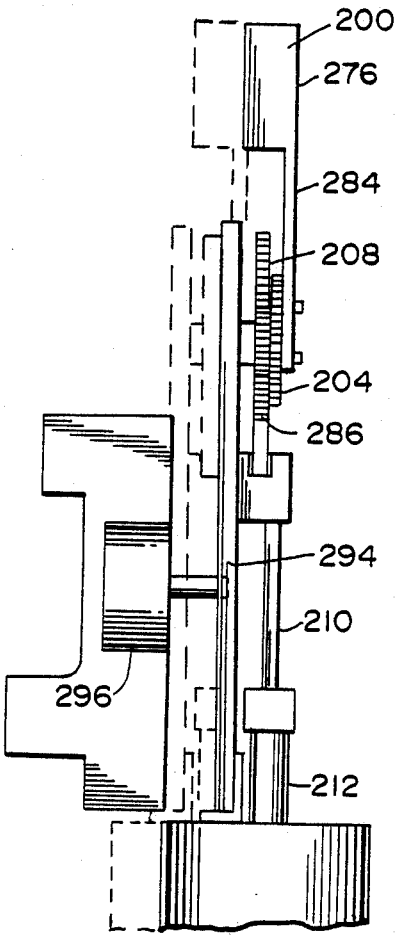
FIG. 13 is a side elevation of the wire tensioning assembly shown in its extended wire straightening positon.

Referring now to FIG. 10 and FIGS. 12–13, the wire tensioning assembly 52 is shown mounted at the front end of the lead pick up station 46. As shown in FIG. 10, the wire tensioning assembly 52 is in a lowered position ready to receive a clamped wire lead 22 brought into the lead pick up station 46. Wire tensioning assembly 52 includes a pair of elongate opposed jaws 200, 202, each including a wire gripping portion 276, 278 with broad V-notches 280, 282 defined therein and an elongate mounting arm portion 284, 286 which are mounted onto rotatable pinion members 204 and 206. Opposite rotation of pinion members 204, 206 causes the wire gripping jaws 200, 202 to swing outwardly and upwardly to a raised wire gripping position shown in FIG. 12. The pinion members 204, 206 are actuated by a rack member 208 including ratchet teeth 209. Rack 208 is raised and lowered by means of a rod 290 connected to an air cylinder actuator 292. The wire tensioning jaws 200, 202 are mounted for eccentric movement on the pinion members 204 and 206 to define a wide sweep of arc to ensure that the trailing end portion of a wire lead 22 is captured within their V-portions 280, 282 as the jaws 200 and 202 are brought together in their upper raised position shown in FIG. 12.

The wire tensioning assembly 52 including jaws 200, 202, pinions 204, 206, rack 208, rod 290 and cylinder 292 are mounted by means of mounting brackets 294, 296 to a plate member 294. Plate member 294 is moveable outwardly upon actuation of another air cylinder 296 as shown in FIG. 13, to pull a gripped wire lead 22 into a taut horizontally extending position at the lead pick up station 46. The configuration of the wire tensioning jaws 200, 202 ensures that the trailing end of the wire lead 22 will be gripped during its upward arched swing to its closed position shown in FIG. 12. Actuation of the entire wire tensioning assembly 52 away from the conveyor clamp jaws 120 ensures that the gripped wire segment will be properly positioned for pick up by the lead insertion jaw assembly 54, regardless of any bends or wiggles present in the trailing end of the wire lead 22 caused by memory imparted during prior termination treatments.

C. The Terminal Guide Jaw Assembly

Figure 15:
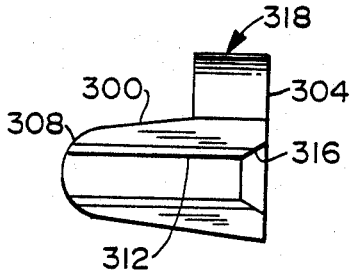
FIG. 15 is an elevated side view of the left terminal guide jaw taken along line 15—15 in FIG. 14.
Figure 16:
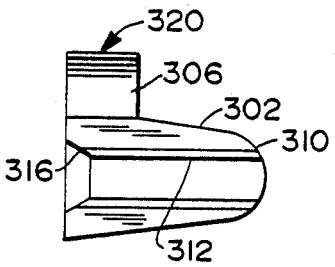
FIG. 16 is an elevated side view of the right terminal guide jaw taken along line 16—16 in FIG. 14.

Referring now to FIGS. 5 and 12–20 the terminal guide jaw assembly 56 is shown. As shown in FIGS. 12 through 18 the terminal guide jaw assembly 56 includes a pair of symmetrical terminal guide jaws including a left guide jaw 300 and a right guide jaw 302 shown. Terminal guide jaws 300, 302 each include a planar mounting end 304, 306 and a forwardly projecting bottle nosed guide portion 308, 310. The inner facing opposing surfaces of the guide jaws 300 and 302 include a terminal receiving groove 312 which in a closed position define a profiled bore 314 extending through jaws 300, 302. As shown in FIGS. 15 and 16, the ends of the grooves 312 may be flared at 316 to provide a guided access to the lead insertion jaw assembly 54 and the terminals 26 provided on the leads 22.

Figure 17:
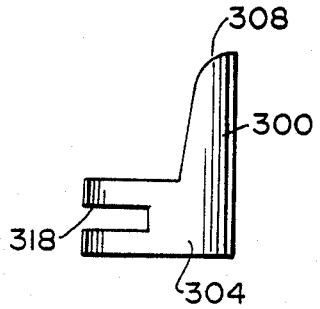
FIG. 17 is a top view of the left terminal guide jaw taken along line 17—17 in FIG. 14.
Figure 18:
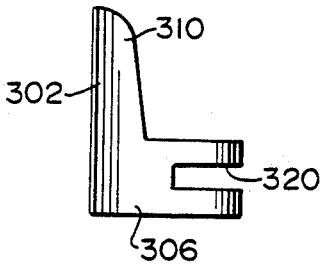
FIG. 18 is a top view of the right terminal guide jaw taken along the line 18—18 in FIG. 14.

As shown in FIGS. 17 and 18, the outer configuration of the forward projecting portions 308, 310 are provided with a bottle nosed contour to aid in deflection of previously inserted wire leads 22 at the insertion station 42. An outer portion of the mounting plate members 304 and 306 include a notch to form yoke members 318, 320 adapted to receive an actuator linkage.

Figure 20:
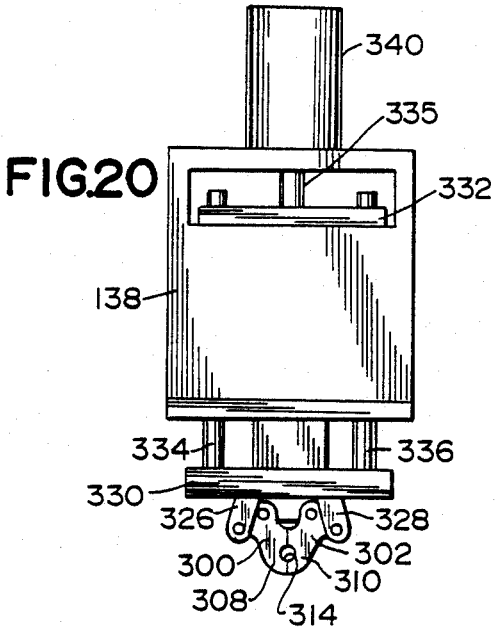
FIG. 20 is a front elevation view of the terminal guide assembly showing the terminal guide jaws and actuator in their closed position.
Figure 19:
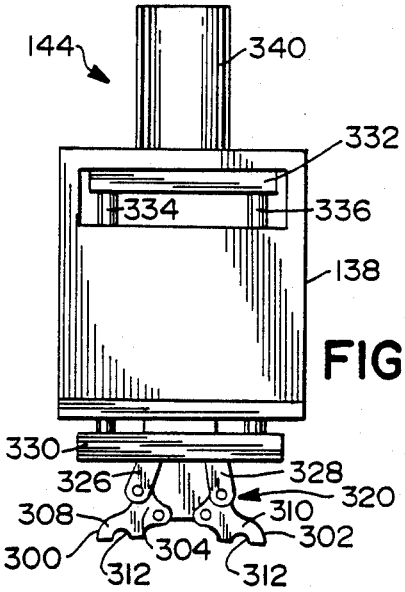
FIG. 19 is a front elevation view of the terminal guide assembly showing the terminal guide jaws and actuator in their open position.
Figure 28:
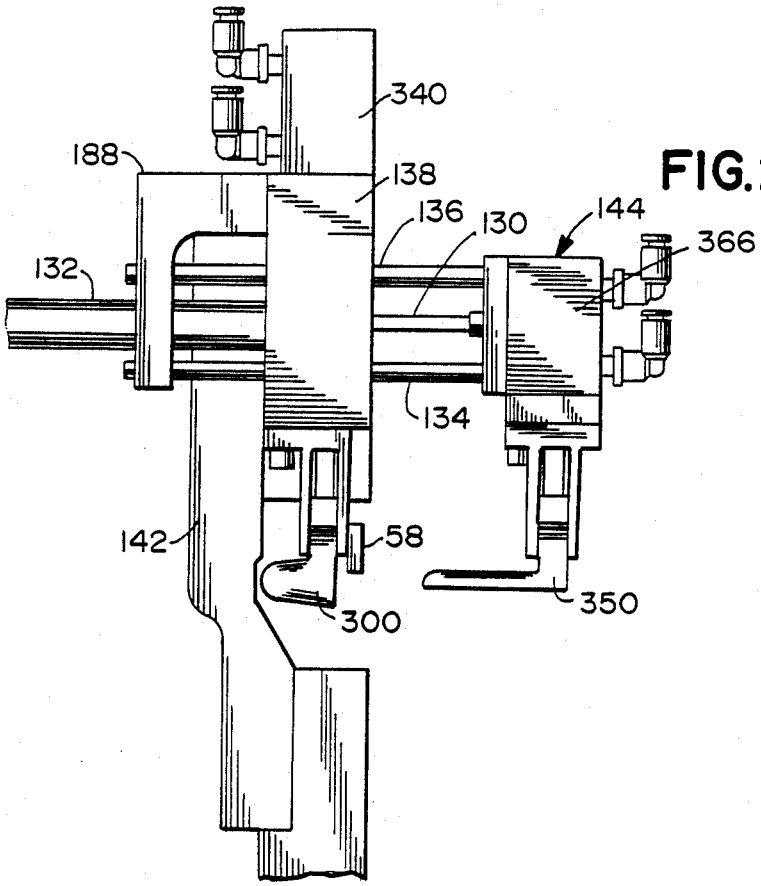
FIG. 28 is a side elevation view of the new and improved lead insertion and terminal guide assemblies.

Referring now to FIGS. 19 and 20, the mounting arrangement for terminal guide jaws 300 and 302 is shown. A picture frame mounting member 138 is cantilevered from vertical mounting arm 140 in position above the lead pick-up station 46. Picture frame member 138 includes a central portion through which the drive assembly (130, 132), for lead insertion jaw assembly 54 passes. The mounting and actuation assemblies for the front terminal guide jaws are shown in FIGS. 19, 20 and 28. As shown therein, a rectangular mounting plate 320 extends from the lower portion of the picture frame 138. The terminal guide jaws 300 and 302 are pivotably mounted to the lower end of the mounting plate 320 by means of rivets 22 which extend through the mounting apertures 322, 324. As shown in FIG. 19, the opposed yoke portions 318 and 320 of the terminal guide jaws 300, 302 are pivotally connected by means of rivets 222 to actuating link members 326 and 328. A pair of horizontally extending plate members including a lower plate member 330 and an upper plate member 332 are interconnected by vertical bars 334 and 336 which extend within the mounting frame 138. The opposed ends of the linker members 326 and 328 are each pivotally connected to the lower horizontal plate 330. The upper horizontal plate 332 is connected to a piston rod 338 (FIG. 20) which is in turn connected to an air cylinder actuator 340. Actuation of air cylinder 340 is effective to raise and lower the horizontal plate members 332 and 330 to move the terminal guide jaws 300 and 302 between an open position shown in FIG. 19 and a closed position as shown in FIG. 20.

As an incoming clamped lead 22 is brought into the lead pick up station 46 by the conveyor assembly 44, the terminal 26 on the lead 22 is disposed underneath the opened terminal guide jaw assembly 56. On an appropriate controller signal, the terminal guide jaws 300 and 302 are actuated to their closed position by the air cylinder 340 as shown in FIGS. 20 and FIG. 28. In their closed position, terminal guide jaws 300 and 302 surround the forward mating portion 28 of the terminal 26. The crimp section 30 and insulation crimp section 32 extend out the back side of the closed terminal guide jaws 300, 302. The profiled bore 314 provided by the terminal guide jaw grooves 312 controls the rotational orientation of the terminal 26 for alignment with a rear opening 18 in a housing cavity 20, preparatory to insertion. Guide jaws 300, 302 also serve to maintain terminal 26 in an aligned position during the manipulations of the lead insertion jaw assembly 54.

C. Lead Insertion Jaw Assembly

Referring now to FIGS. 21 through 25, detailed views of the new and improved lead insertion jaws 350, 352 for use in apparatus 10 are shown. As shown in FIG. 21 the lead insertion jaws 350, 352 each include a rearward planar mounting portion 353, 355 and elongate forwardly projecting needle nosed portions 354, 356, as shown in FIG. 22–25. The inner surfaces of lead insertion jaws 350 and 352 are provided with semicircular wire gripping grooves 360, 361. Yokes 362 and 364 are provided in the outer portions of mounting portions 353, 355 adapted to receive a linkage.

Figure 26:
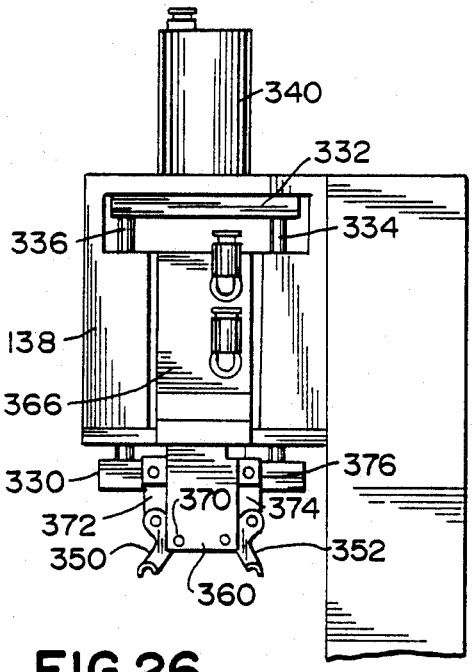
FIG. 26 is a front elevation view partly in section of the lead insertion jaw assembly of this invention showing the lead insertion jaws and actuator in their first open and retracted position.
Figure 27:
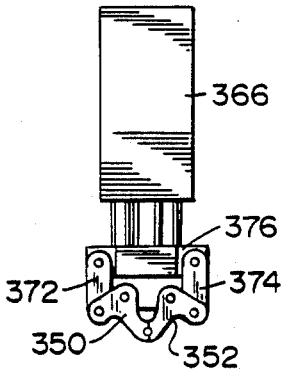
FIG. 27 is a front elevation view, partly in section, of the lead insertion jaw assembly showing the lead insertion jaws and actuator in their second intermediate position, wherein the lead insertion jaws are brought into a slidable low pressure gripping engagement with a wire lead.

As shown in FIGS. 26 through 28, the lead insertion jaws 350 and 352 are a part of the lead insertion jaw assembly 54 which further includes a gripper control means 128 and a lead insertion jaw drive assembly (130, 132). More particularly, gripper control means 128 includes an air cylinder actuator equipped with a programmable regulator. Lead insertion jaws 350, 352 are pivotally mounted to a depending mounting plate 368 member by rivets 222 extending through their mounting apertures 370. The yoke portions 362 and 364 are pivotably connected to a pair of linker members 372, 374 which are in turn pivotably connected to a horizontal plate member 376. Horizontal plate member 376 is connected to an actuator rod 378 connected to the regulated air cylinder 366 of gripper control means 128.

Gripper control means 128 is effective to actuate the insertion jaws 350 and 352 between an open position shown in FIG. 26 and an intermediate wire gripping position as shown in FIG. 27. In the intermediate wire gripping position shown in FIG. 27, horizontal plate 376 plate has been downwardly actuated by the gripper control means 128 to close the jaws 350 and 352 in surrounding longitudinal engagement with the wire lead 22. In the intermediate gripping position shown in FIG. 27, the regulator on air cylinder 366 provides a sufficient inward gripping pressure for the insertion jaws 350 and 352 to grippingly engage opposed sides of a wire segment 24. However, the grip is of a low enough pressure to permit insertion jaws 350 and 352 to slide axially along a gripped wire segment. Typically, in the intermediate position, lead insertion jaws 350 and 352 are closed in engagement about a wire segment with a pressure delivered by the air cylinder 366 of approximately 2 to 40 psi.

The gripper control means 128 is also effective to actuate lead insertion jaws 350 and 352 from their intermediate low pressure slideable grip position shown in FIG. 27, to a high pressure grip or third position. In the third position the insertion jaws 350 and 352 are in a position similar to that shown in FIG. 27 however the gripping pressure of jaws 350 and 352 on the gripped wire segment has been increased to a high pressure non-slideable grip, wherein the lead insertion jaws 350 and 352 actually compress the insulation coating surrounding the wire leads 22.

Figure 44:
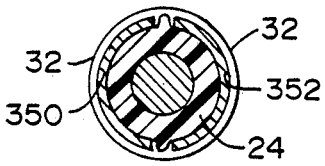
FIG. 44 is an elevated view partly in section taken along lines 44—44 in FIG. 43, showing the lead insertion jaws in their third high pressure gripping position on the terminated lead immediately before insertion.
Figure 14:
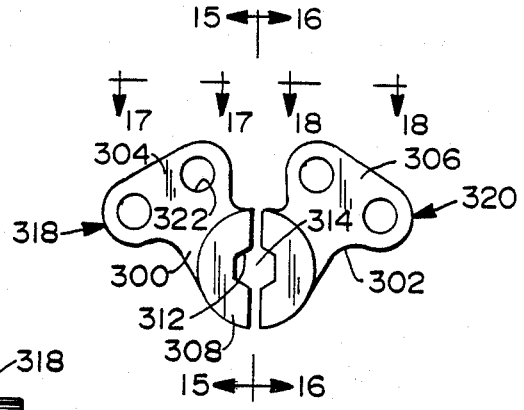
FIG. 14 is a front elevation view of the terminal guide jaws partly in section, for use in the lead insertion apparatus of this invention.

In the third high pressure grip position increased gripping pressure is provided by further downward actuation and pressure on horizontal plate member 376 by regulated air cylinder 366. This causes the lead insertion jaws 350 and 352 to grip the wire in the high pressure non-slideable grip as shown in FIG. 44. More particularly, as shown in FIG. 44, lead insertion jaws 350 and 352 actually compress the insulation surrounding the wire lead so that the tip portions of the lead insertion jaws abut against the relatively raised insulation crimp section 32 of terminal 26 as shown.

The low pressure and high pressure settings for the adjustable gripper control means 128 may be set by means of thumb wheel switches adjusted or set by hand. As has been mentioned above, the sliding gripping force provided by jaws 350 and 352 on wire lead 22 in the intermediate position can vary between 2 and 40 psi. In the high pressure grip or third position, the gripping pressure applied is generally 10 to 15 times the intermediate pressure or above about 120 psi. In this third position, lead insertion jaws 350 and 352 are not longitudinally slideable along the gripped lead 22. The mounting arrangement for the insertion jaws provides sufficient mechanical advantage so that the regulated air pressure delivered to air cylinder 366 can be up to about 150 psi, and the insertion jaws will exert gripping pressures on the lead in excess of 120 psi.

The gripper control assembly and 128 and lead insertion jaws 350 and 352 are mounted for movement along the Y-axis of the apparatus by means of a drive rod member 130 which is actuated by air cylinder 132. Drive rod 130 and air cylinder 132 are mounted through the central portion of the mounting picture frame member 38 from which the terminal guide jaws 300 and 302 extend. The lead insertion drive assembly (130, 132) is effective to move the gripper control assembly 128 and insertion jaws 350 and 352 disposed in their intermediate position along the wire segment until the forward tips of jaws 350 and 352 are underneath the proximity sensor 58 positioned at the rear end of the terminal guide jaw assembly 56. Proximity sensor 58 sends a signal to the gripper control means 128 to change the grip position of the lead insertion jaws 350, 352 from the intermediate slideable gripping position to the high pressure grip position set previously by the thumbwheel switch arrangement. Thereafter the drive means 130 and 132 is further effective to actuate the forward portions of the lead insertion jaws 350 and 352 entirely through the internal bore 314 formed by closed terminal guide jaws 300 and 302 into rear opening 18 of the connector housing 12 aligned at the insertion station 42.

E. Housing Indexing Module

Referring now to FIGS. 29–36, the programmable housing index module 68 is shown with other features of apparatus 10 removed for clarity. In the top view shown in FIG. 29, the timing belt 378 for rotating the Z-axis drive screw 214 is shown. Also shown in FIG. 29 is an end portion of an air cylinder actuator 380 disposed on the underside of connector clamp 70 for actuating connector clamping end plate 146 and ejector pawls 176 and 178.

Figure 30:
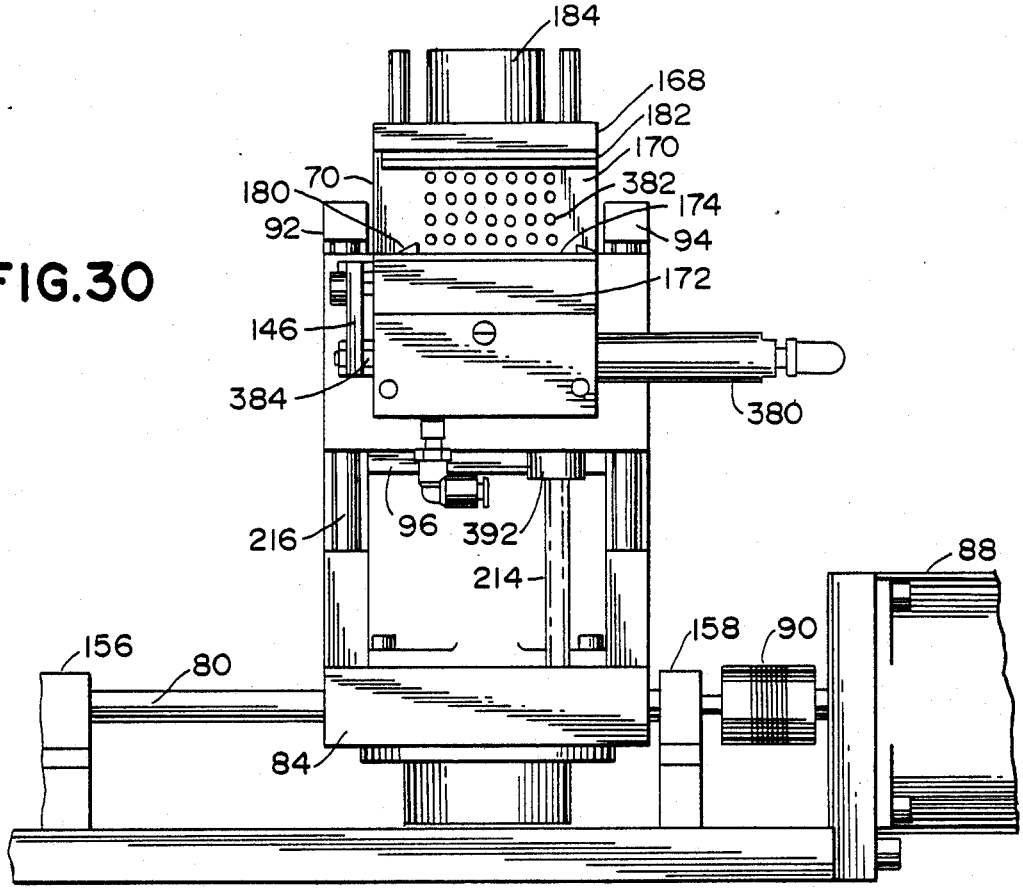
FIG. 30 is a front elevation view of the programmable connector indexing module.

Referring now to FIG. 30, the front elevation view of the connector indexing module 68 is shown. The connector clamp 70 is shown to include a top wall 168 with a moveable top clamp member 182. Clamp member 182 is driven by rods extending through top wall 168 which are connected to clamp air cylinder 184 for vertically moving the top clamp member 182 downwardly to engage the upper surface connector housing 12 inserted into clamp 70. Clamp 70 also includes vertically extending rear wall 170 provided with plurality of test probe apertures 382 which are arranged in a matrix of columns and rows corresponding to the front openings provided in the mating face 14 of the connector 12 inserted into the clamp 70. The clamp 70 also includes a lower base portion 172 including an upper surface 174. Connector stop pawl 180 extends upwardly from the left hand of surface 174. Connector eject pawls 176 and 178 are shown extending upwardly from the right hand portion upper surface 174. Also shown extending from the left portion of base portion 172 is end plate 146 and attached cylindrical actuator rod 384. The lower actuator rod 384 is connected to air cylinder 380 which actuates the end plate member 146 in a leftward direction as shown in FIG. 30. Leftward movement of end plate 146 cammingly lowers the connector stop pawl 180 and advances the connector eject pawls 176 and 178 in a leftward direction to discharge a completed wire harness from the connector clamp 70 into the harness eject station 62.

Also shown in FIG. 30 are the Z-axis guide rail 216 and Z-axis drive screw 214.

Figure 31:
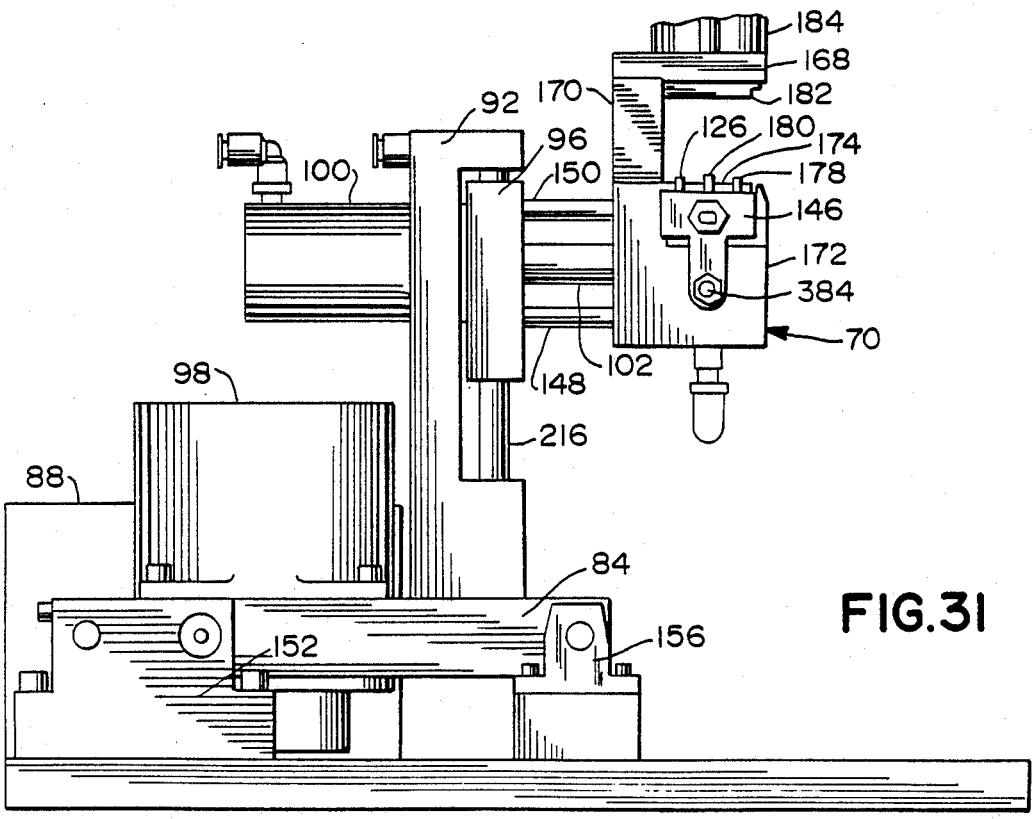
FIG. 31 is an elevated side view of the programmable connector indexing module.

Referring now to the side view shown in FIG. 31, T-shaped end plate member 146 is provided on the lefthand side of the connector clamp 70 as shown. Connector eject pawls 176 and 178 are shown extending on opposed sides of the upper surface 174. The eject pawls 176 and 178 are fixedly connected to cylindrical rods 386 and 388 extending within the lower base portion 172 of connector clamp 70 which are affixed to the T-shaped end plate member 146. A camming rod 390 for lowering the connector stop pawl 180 is mounted in the center of the upper portion of the T-shaped end plate 146. At the base of the T-shaped end plate 146 actuator rod 384 is fixedly mounted.

The lower base portion 172 of the connector clamp 70 is mounted onto a drive rod 102 which extends through the vertical platform 96 to the Y-axis air cylinder 100. The Y-axis air cylinder 100 is fixedly mounted to the opposed side of the vertical platform 96 and is operative to move the connector clamp 70 reciprocally along the Y-axis of the insertion station 42. A pair of stabilizer rails 148 and 150 also extend rearwardly from the base portion 172 of the connector clamp 70 to stabilize the Y-axis movement.

The Z-axis guide rails 216 on which the vertical mounting platform 96 travels are shown in FIG. 31. The vertical mounting brackets 92 and 94 are shown to include a C-shaped cut out into which the Z-axis guide rails 216 are mounted.

Figure 32:
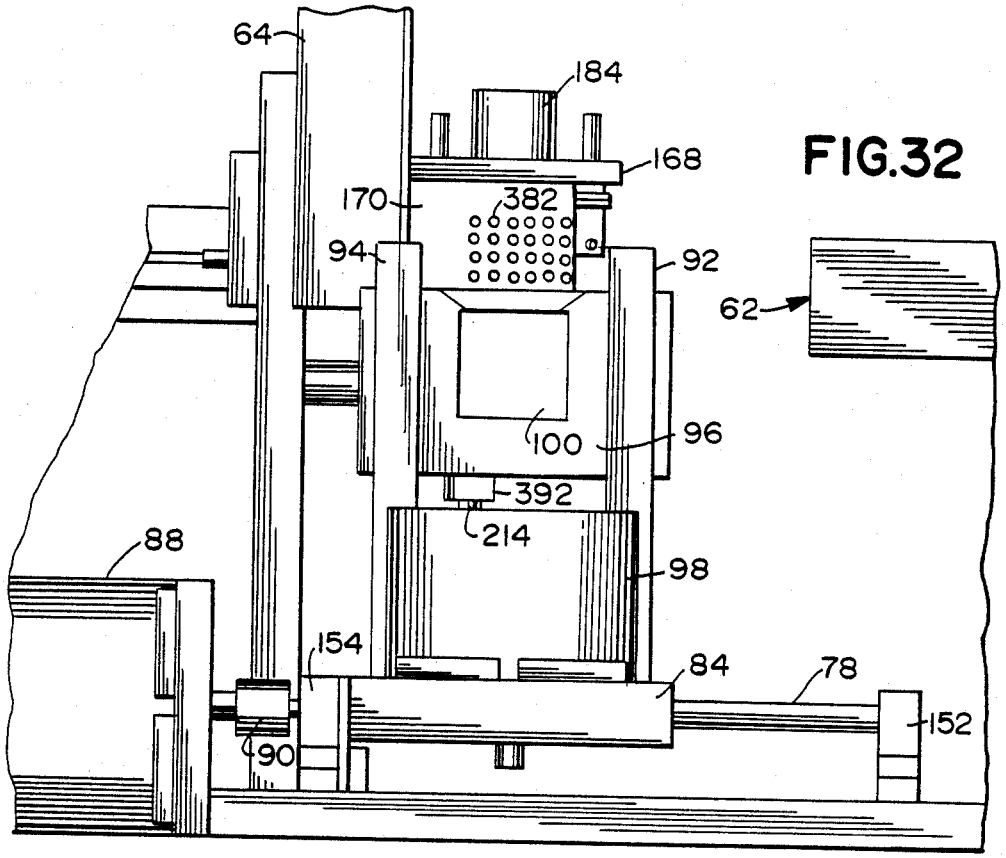
FIG. 32 is a rear elevation view of the connector indexing module.

Referring now to FIG. 32 the rear wall 170 of the connector clamp 70 with its test probe apertures 382 is shown above the Y-axis actuator cylinder 100. The vertical mounting platform 96 includes a stationary threaded Z-axis drive bushing 392 which rides on the threads of the Z-axis drive screw 216. Clockwise or counterclockwise rotation of the Z-axis drive screw by the Z-axis stepper motor with encoder is effective to raise or lower vertical platform 96.

Although a Y-axis air cylinder 100 for controlling movement of the connector clamp 70 in the Y-axis direction is shown, it will be readily apparent to those skilled in this art that the Y-axis movements of clamp 70 may also be controlled by a stepper motor with encoder connected to a drive screw, similar to the drive mechanisms shown for the Z-axis and X-axis.

Referring now to FIG. 33, a cross section of the connector clamp pawl system is shown. As indicated therein, the connector eject pawls 176 and 178 are spring loaded but mounted for travel on cylindrical rods 386 and 388. The connector stop pawl 180 is disposed at the opposed end of the connector clamp 70 between the eject pawls 176 and 178. The connector stop pawl 180 is located above a camming rod 390 which is adapted to travel on actuation of the end plate 146 by air cylinder 380 to deflect connector stop pawl 180 downwardly to permit exiting of the completed harness out of the clamp 70.

Figure 34:
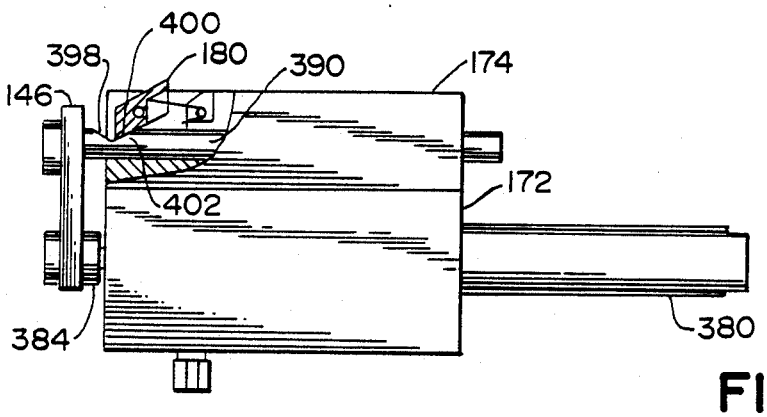
FIG. 34 is an elevated cross sectional view of the connector stop pawl of the connector housing clamp taken along line 34—34 in FIG. 30.
Figure 35:
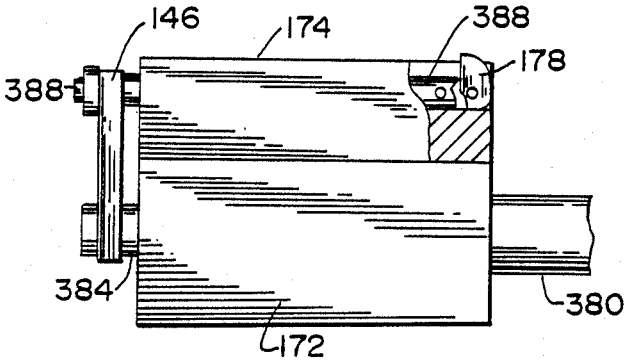
FIG. 35 is an elevated cross-sectional view of the connector eject pawls of the connector housing clamp taken along line 35—35 in FIG. 30.

Referring now to FIGS. 34 and 35, detailed views of the pawl system on connector clamp 70 are now shown. Referring more particularly to FIG. 34, at the left side of the base portion 172, the connector stop pawl 180 is shown spring loaded in an upward position to engage an advancing leading corner of the connector housing 12 inserted into clamp 70. The camming rod 390 mounted for travel with end plate 146 includes a V-shaped notch 398 which is adapted to engage the lower corner 400 of the rotatably mounted connector stop pawl 180. Upon leftward advancement of the end plate 146 and cam rod 390, the camming surface 402 on rod 390 engages lower corner 394 of stop pawl 180 which rotates pawl 180 downwardly to permit the connector to exit leftwardly from connector clamp 70.

Referring now to FIG. 35, the connector eject pawls 176 and 178 are shown spring loaded to an upward position but are rotatable in a counterclockwise direction to a lowered position. A connector housing 12 may be pushed by the connector load assembly 66 to deflect the ejector pawl members 176 and 178 downwardly thereby permitting the housing 12 to be inserted into connector clamp 70 until leftward advance is stopped by the spring loaded raised connector stop pawl 180. The spring loading of the eject pawls 176 and 178 causes them to return to their raised position so that they engage the right hand corner of inserted connector housing 12. The pawls 176 and 178 are mounted to cylindrical drive rods 386 and 388 extending through base member 172 of the connector clamp 70. Rods 386 and 388 are in turn mounted on the end plate member 146. End plate member 146 is actuated leftwardly by means of the piston rod 384 and associated with the air cylinder actuator 380 to carry a connector housing 12 out of the connector clamp 70 into the harness eject track 108.

Figure 36:
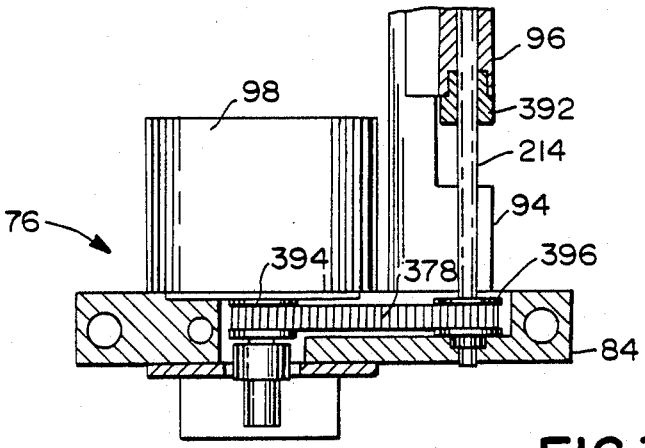
FIG. 36 is an elevated rear view of the programmable connector indexing module similar to FIG. 33, but showing the Z-axis drive mechanism in section.

Referring now to FIG. 36, the Z-axis drive assembly 76 is shown disposed in the horizontal mounting platform 84 to include a pair of spaced apart drive gears 394 and 396. Drive gear 394 is attached to the end of a rotor 398 driven by Z-axis stepper motor and encoder 98. Drive gear 396 is attached to the lower end of the stationary but rotatably mounted Z-axis drive screw 214. Z-axis timing belt 378 transmits rotation of the drive motor 98 to the Z-axis drive screw 214 in either a clockwise or counterclockwise direction. A stationary threaded bushing 392 in the vertical mounting platform 96 causes platform 96 to ride along the Z-axis drive screw 214 upon rotation thereof.

F. Automated Insertion Sequence

Figure 37:
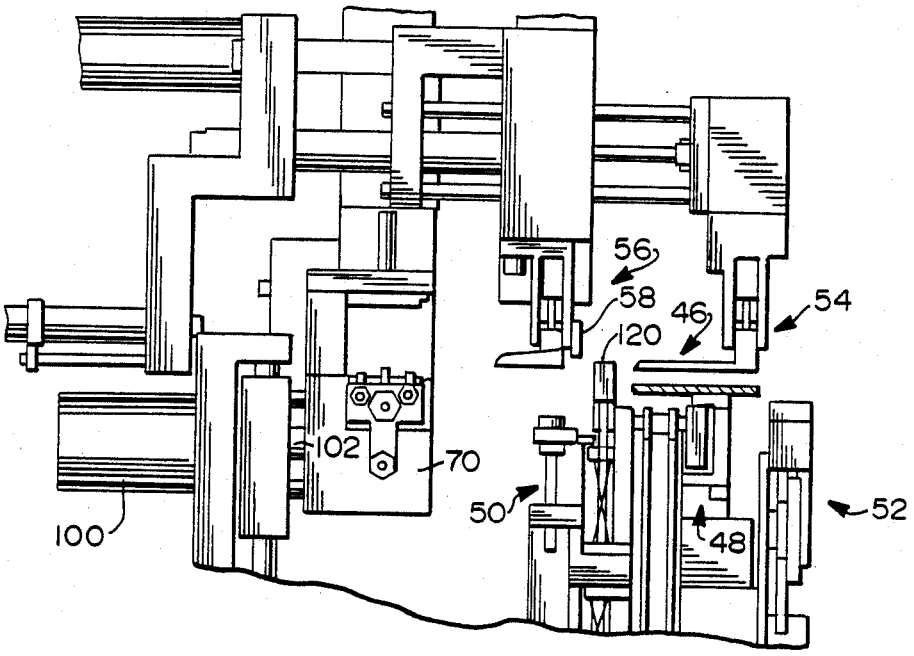

Referring now to FIGS. 37 through 50, the sequential steps of a lead insertion performed by the various assemblies of the new and improved lead insertion apparatus 10 are shown. Referring now to FIG. 37, the various assemblies of lead insertion apparatus 10 are shown in a ready or start position. At this stage, lead pick up station 46 is empty. Connector clamp 70 is in a fully retracted position. The terminal guide jaw assembly 56 is in its open position. Lead insertion jaw assembly 54 is in its rearward and open position. Wire tensioning jaw assembly 52 is in its lowered or retracted position.

Figure 38:
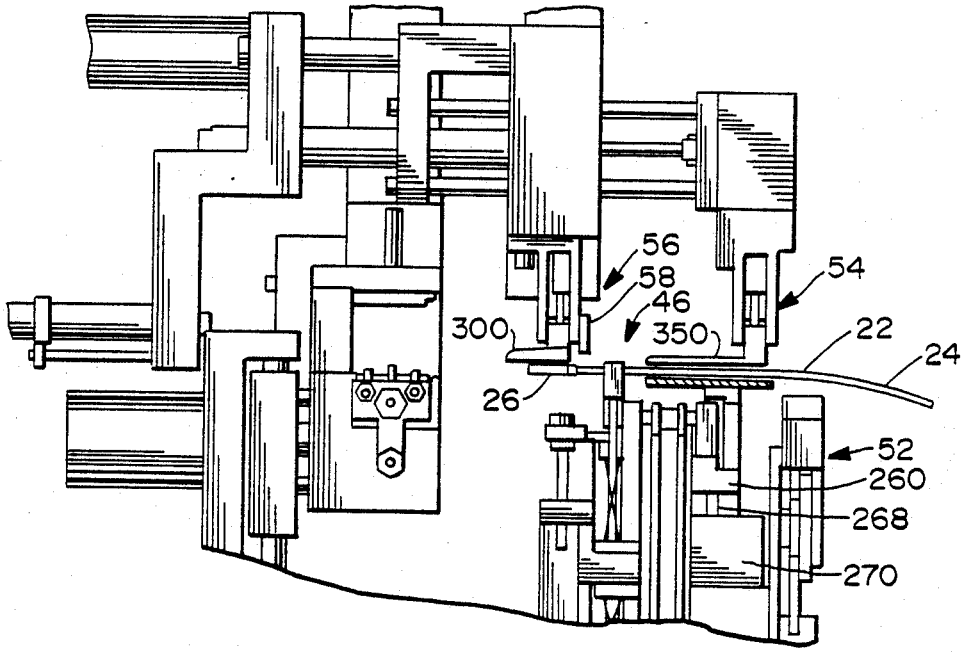

Referring now to FIG. 38, the lead conveyor assembly 44 has conveyed a terminated wire lead 22 mounted in a closed conveyor clamp 120 into the lead pick-up station 46. Shot pin assembly 48 engages the forward corner of the rectangular pawl member 124 to positively position clamp 120 and lead 22 in the lead pick-up station 46.

Figure 39:
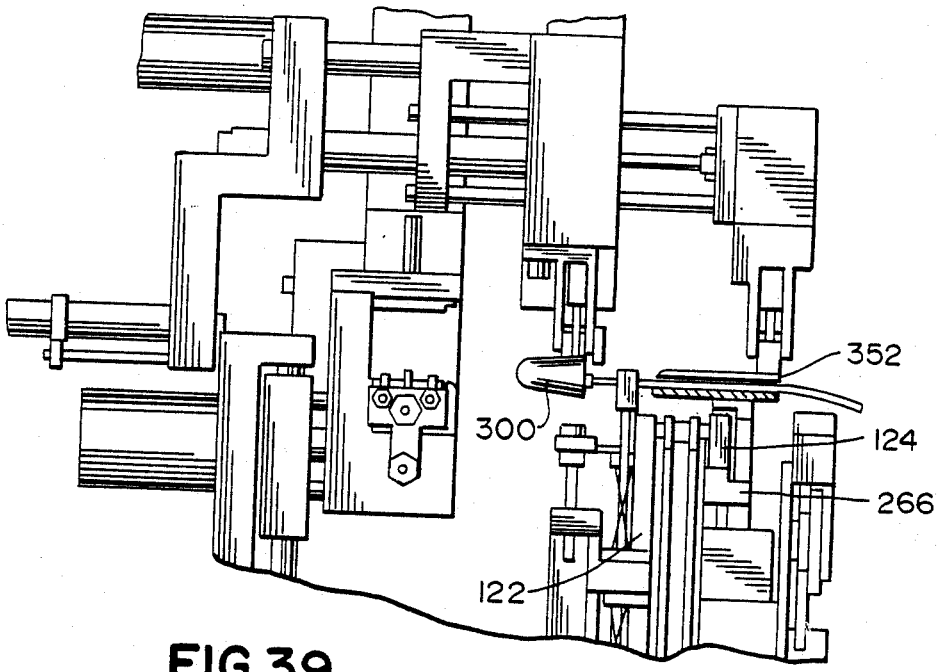

Referring now to FIG. 39, the terminal guide jaw assembly 56 has been actuated to its closed position, wherein the terminal guide jaws 300 and 302 surround and enclose forward mating portion 28 of terminal 26 on lead 22.

Figure 40:
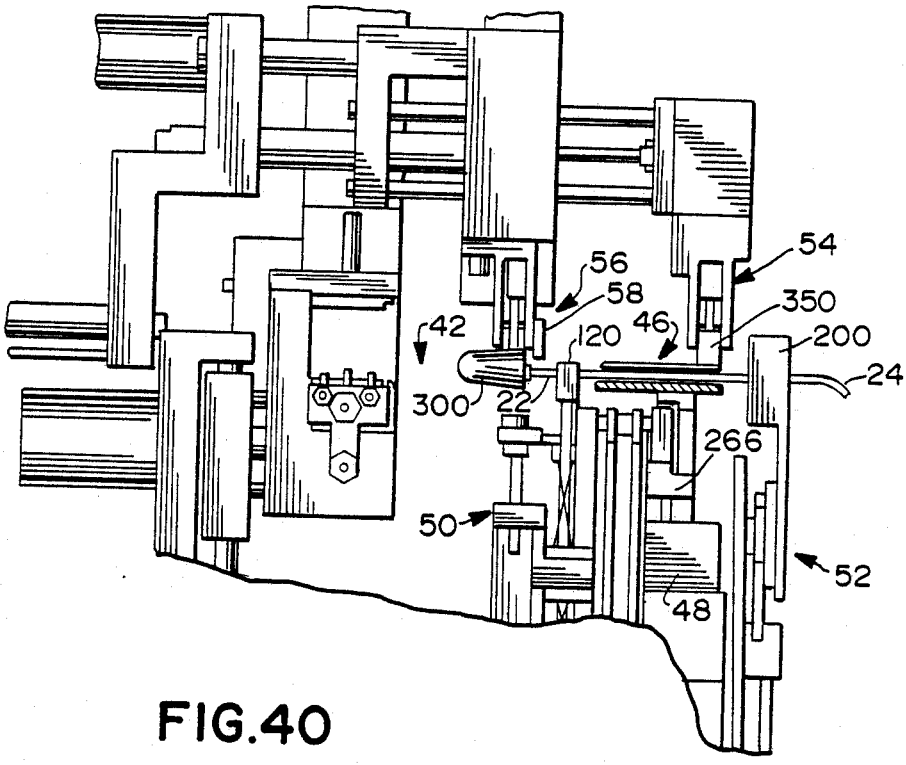

Referring now to FIG. 40, the wire tensioning jaw assembly 52 has been actuated so that the tensioning jaws 200 and 202 are moved to their raised position gripping the trailing end of wire lead 22. The terminal guide jaw assembly 56 remains in its closed position. Conveyor clamp 120 remains in its closed position.

Figure 41:
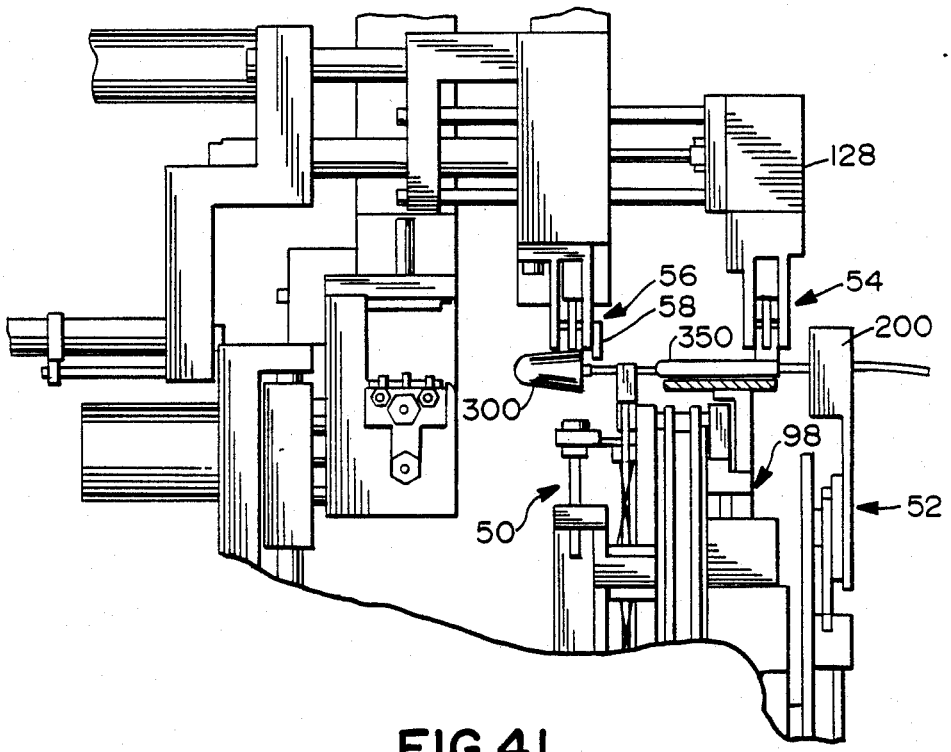

Thereafter, as shown in FIG. 41, the wire tensioning assembly 52 is laterally actuated by air cylinder 296 to an extended position in order to present a horizontally extending taut lead wire segment 24 to the insertion jaw assembly 54. The gripper control means 128 has actuated the lead insertion jaws 350 and 352 from the open position shown in FIG. 40, to their second intermediate position. As shown in FIG. 41, lead insertion jaws 350 and 352 are in surrounding slideable engagement with the lead 22.

Figure 42:
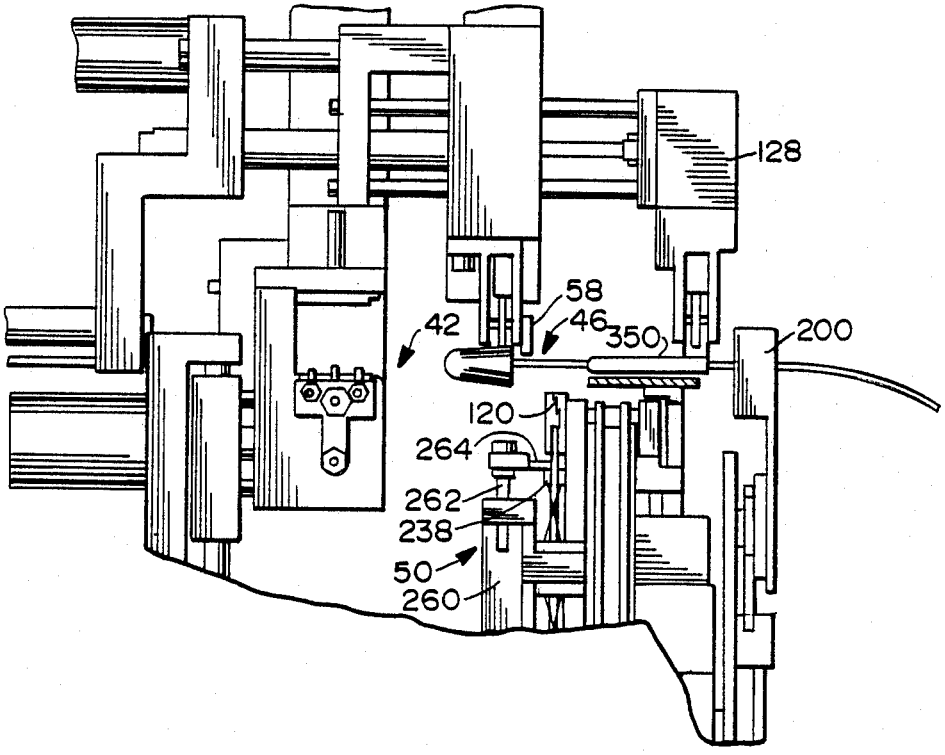

Turning now to FIG. 42, with the front mating portion 28 of the terminal 26 secured within the terminal guide jaws 300 and 302, the rear portion of lead 22 gripped and straightened by wire tensioning jaws 200 and 202 and with wire segment 24 slideably gripped between lead insertion jaws 350 and 352, the clamp opening air cylinder 260 is actuated to its lowered position causing opener pawl 264 to open the conveyor clamp 120.

Figure 43:
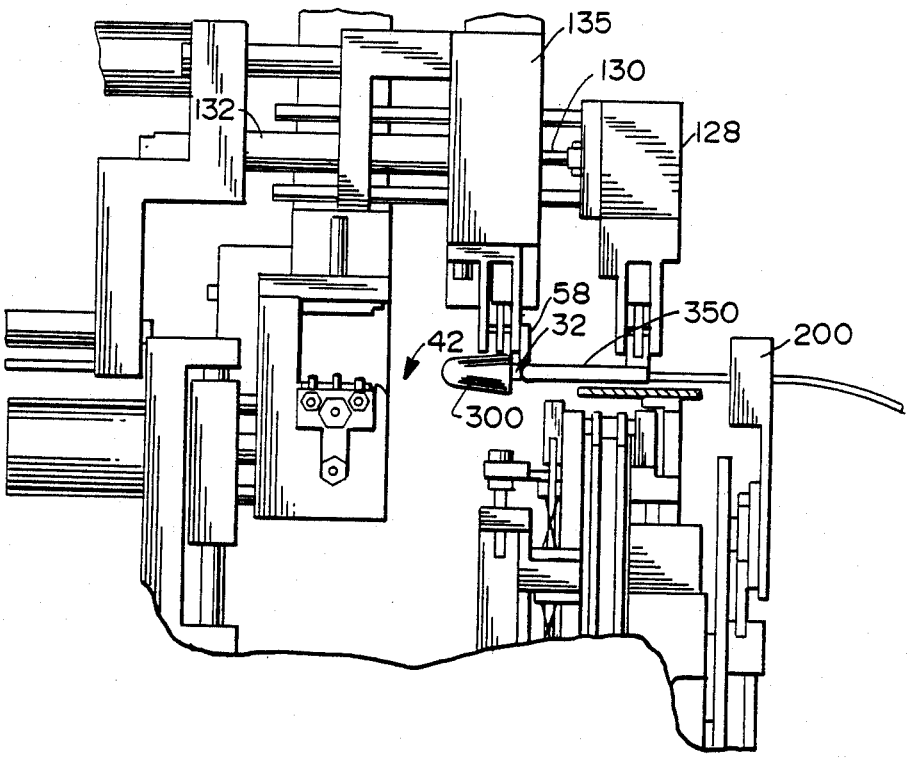

Thereafter, as shown in FIG. 43, the lead insertion jaw drive assembly 130 and 132 is actuated to move the gripper control 128 and lead insertion jaws 350 and 352 forwardly along gripped wire segment 24 towards the closed terminal guide jaws 300 and 302 and proximity sensor 58 mounted on the rear of terminal guide assembly 56. Air cylinder 132 and drive rod 130 are retracted thereby moving lead insertion jaws 350 and 352 along wire segment 24 toward the rear end 32 of the terminal 26 until the forward tips of lead insertion jaws 350 and 352 are sensed by the proximity sensor 58. In response to the sensing signal from the proximity sensor 58, gripper control means 128 changes the gripping position of the lead insertion jaws 350 and 352 from their intermediate slideable grip position to their third high pressure grip position.

As shown in FIG. 44, the lead insertion jaws 350 and 352 in their third high prssure gripping position are positioned so that their tips abuttingly engage the rear end portion 32 of the terminals 26. The wire column of the lead is surrounded and supported by elongate lead insertion jaws 350 and 352 and the tips of jaws 350 and 352 are in position to push against the rear 32 of the metallic terminal 26.

Figure 45:
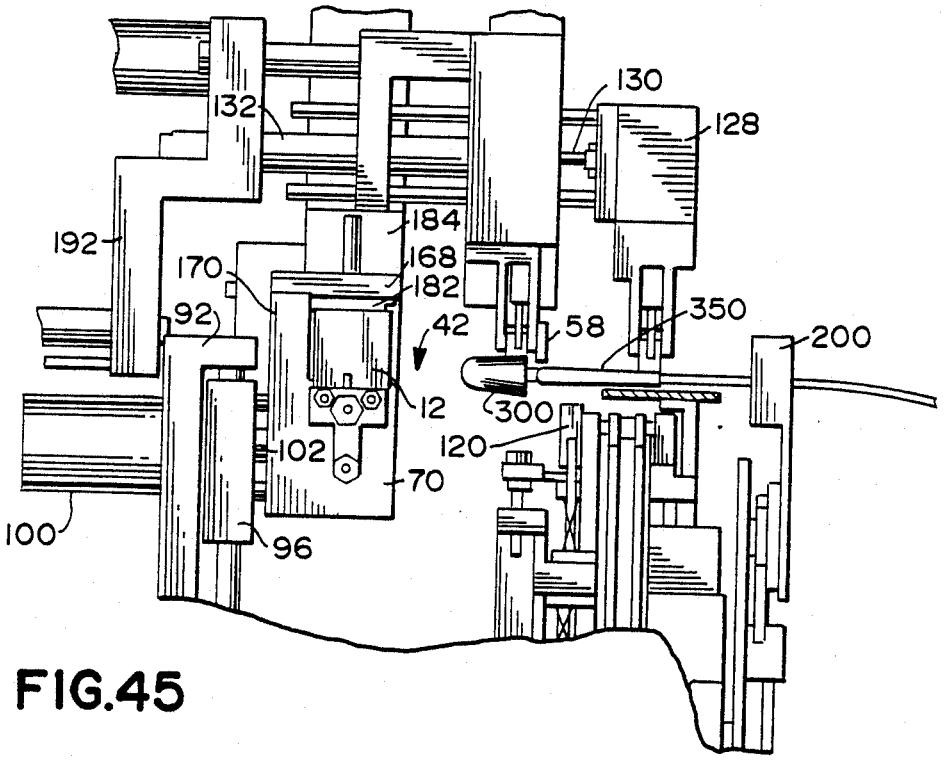

Turning now to FIG. 45, a connector housing 12 has been pushed into connector clamp 70 by means of a pusher rod and actuator 162 which has pushed the lowermost connector housing 12 from the magazine feed 64 along the connector pick up station 60 over the deflectable connector eject pawls 176 and 178 and into position within the connector clamp 70 against the connector stop pawl 180. The air cylinder 184 has actuated the clamping plate member 182 to a lowered position in order to firmly grip and position connector housing 72 within the clamp 70. In this position, the forward openings in mating ends 14 of the connector 12 are brought into registration with the test probe apertures 382 provided in rear wall 170 of connector clamp 70. In this position, the wire tensioning jaws 200 and 202 are still in their extended tensioning engagement on the gripped wire lead 22.

Figure 46:
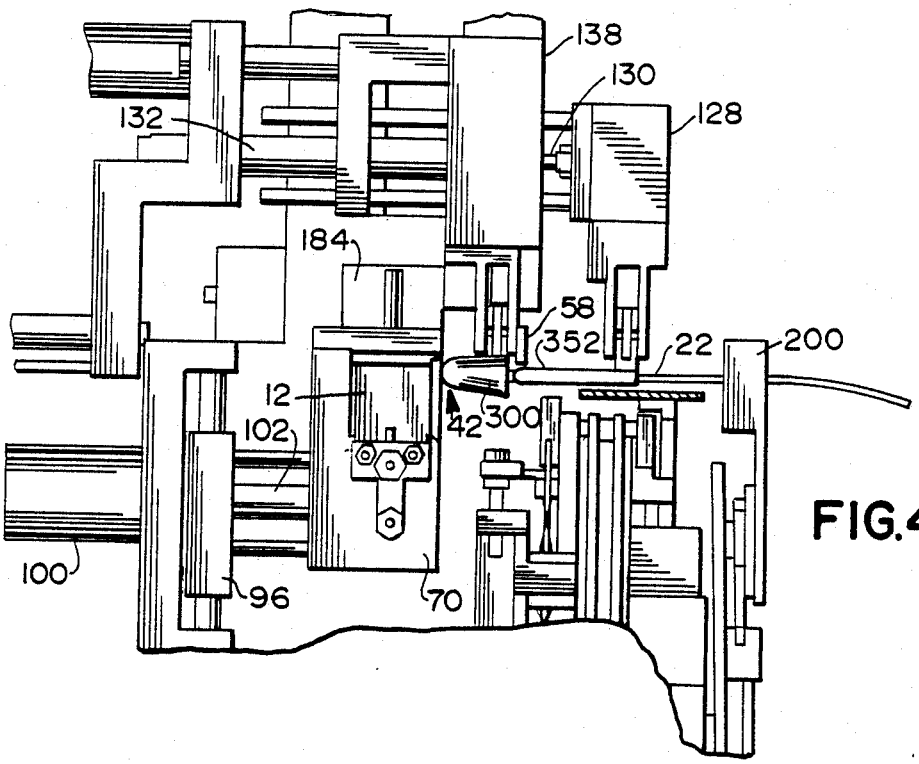

Referring now to FIG. 46, the X, Y and Z axis drives 72–76 have indexed the connector clamp 70 and clamped housing 12 along a desired path into an aligned position at termination station 42 so that one rear opening 18 and connector cavity 20 is brought into an aligned position with the profiled bore 314 of the terminal guide jaws 300 and 302.

Figure 47:
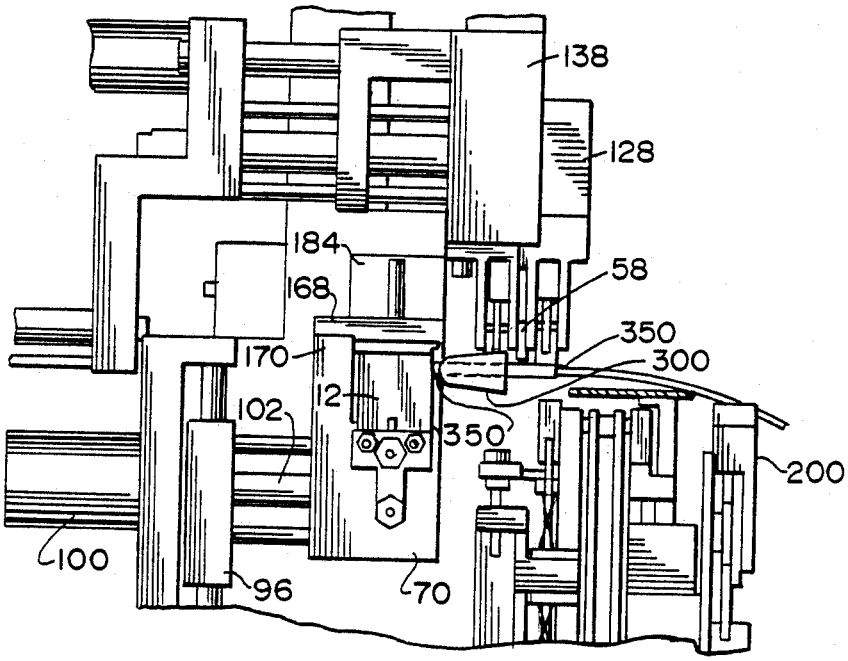

The actual lead insertion step is shown in FIG. 47. As shown therein, rear wire tensioning jaws 200 and 202 have been actuated to their open and retracted position. The lead insertion jaw drive assembly 130 and 132 has moved the lead insertion jaws in their third position through the profiled bore 314 of the terminal guide jaws 300 and 302 until forward tips of lead insertion jaws 350 and 352 are engaged within aligned rear opening 18 of connector cavity 20. In this motion, the unique configuration of the lead insertion jaws 350 and 352 has supported the wire column 24 and pushed against the rearward metal portions 32 of the terminal 26 to overcome the insertion resistance between the terminal 26 and housing 12 and has advanced terminal 26 to its fully seated position within the connector cavity 20.

Figure 48:
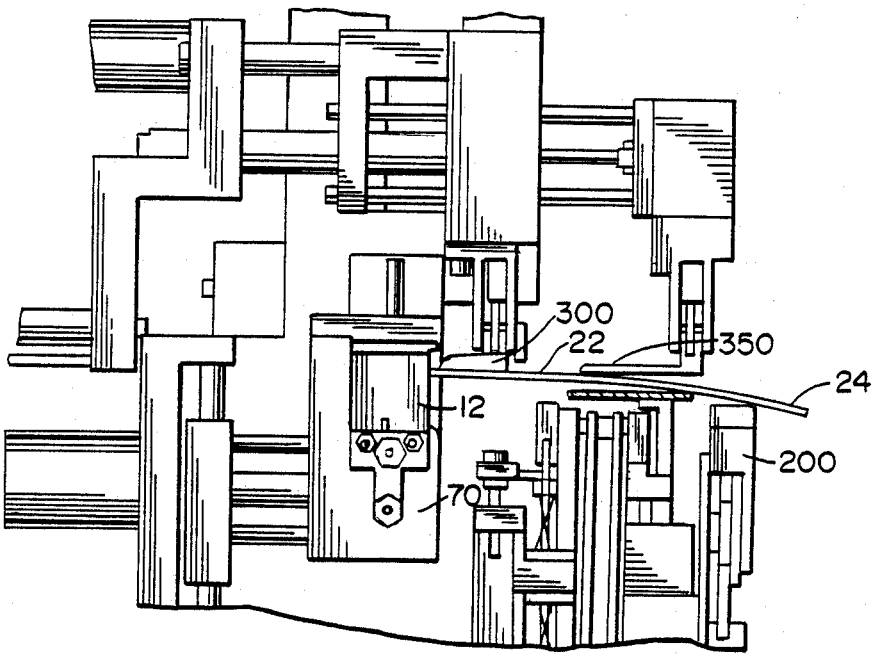

After completion of the insertion stroke, the lead insertion jaw assembly 54 is actuated to its fully retracted position as shown in FIG. 48. Moreover, front terminal guide jaws 300 and 302 have been opened. At this point in the insertion sequence, a push test can be performed on the inserted terminal 26 to determine if it has been fully seated and locked within the connector housing cavity 20. The optional push test features of the invention may be understood with reference to FIGS. 5 and 48.

More particularly, as shown in the upper left hand corner of FIG. 5, there is provided a Z-shaped mounting bracket 192, air cylinder actuator 194 and rod member 190 attached to L projection 188. The upper portion of the Z-shaped mounting bracket 192 is adapted for axial movement along the Y-axis of insertion station 42. On the lower portion of the Z-shaped mounting bracket 192 another probe air cylinder 196 is mounted which actuates a push test probe pin 198 along the Y-axis of the insertion station 42.

Referring now to FIG. 48, the air cylinder actuator 194 for moving the Z-shaped bracket 192 along the Y-axis can be actuated to bring the lower portion of the Z-shaped bracket 192 into abutting engagement with rear wall 170 of connector clamp 70. Thereafter, the push test pin probe actuator 196 may be actuated to extend the pin probe 198 through a test probe aperture 382 in rear wall 170 of connector clamp 70 and into a forward mating opening in connector housing 12. Pin probe 198 may be extended to engage the pin receiving contract portion 28 of the installed terminal 26 and to provide a desired level of push-out pressure against terminal 26 to test whether or not it has been firmly secured within the connector cavity 20 by means of resilient locking tang 34 or other feature.

Alternatively, the push test probe 198 may be actuated to its extended position before the lead insertion jaws 350 and 352 push the terminal 26 into cavity 20. Thereafter, as the terminal is inserted, the probe 198 and cylinder 196 may be set up to sense displacement of the probe 198 thereby providing an insertion depth type test for determining completed insertion of the lead 22. Pin probe 198 may also be extended into the cavity 20 to engage the forward mating end 28 of the terminal 26 to guide slideable longitudinal alignment of the forward mating portion 28 in the cavity 20 as the insertion jaws 350 and 352 push on the rear end 32 of terminal 26 to provide smoother terminal insertion along the cavity length.

Another testing feature will be readily apparent to those skilled in the art. For example, a pull test may be performed by the insertion jaws 350 and 352 during their return to a starting position. After completion of insertion, insertion jaws 350 and 352 can be moved to their intermediate position and retracted to a spaced position from the housing 12. Thereafter, the gripper control means 128 can again actuate insertion jaws 350 and 352 to their third closed position. With the pin probe 198 in contact with the metallic mating contact portion 28 of the terminal 26, the lead insertion jaw drive assembly 130 and 132 can apply a predetermined pull out pressure on the inserted lead 22. The pin probe 198 can provide electrical continuity testing and after completion of the pull test, may be used to sense whether or not the mating portion 28 of terminal 26 is still in proper forward position in housing 12 by either a mechanical displacement or electrical continuity test.

Figure 49:
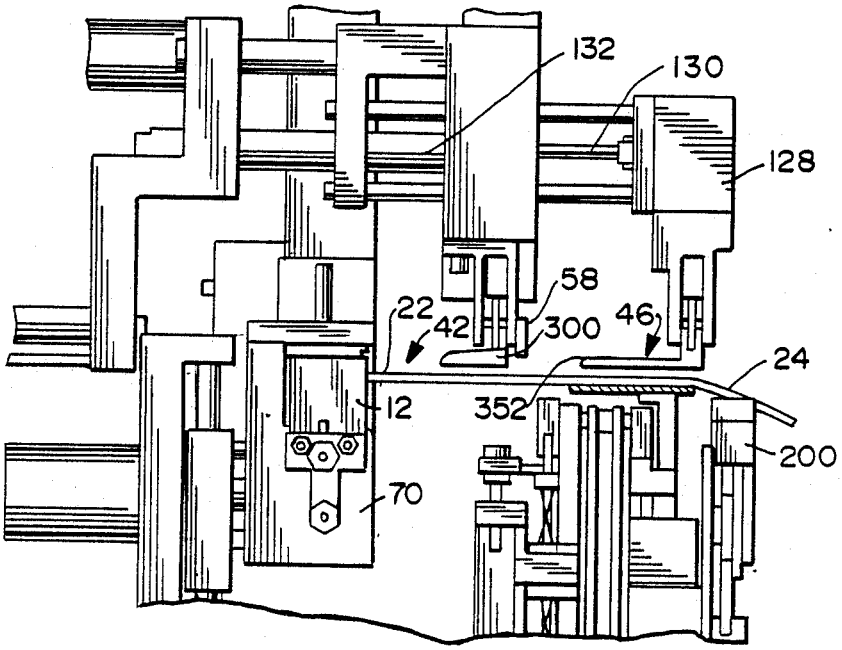

Referring now to FIG. 49, after terminal guide jaws 300 and 302 are actuated to their open position and lead insertion jaws 350 and 352 have been fully retracted and actuated to their open position, connector clamp 70 is indexed out of insertion station 42 to a rearward or home position adjacent the connector pick up station 60. The trailing end of the inserted wire lead 22 extends through the insertion station 42 and the lead pick up station 46.

Figure 50:
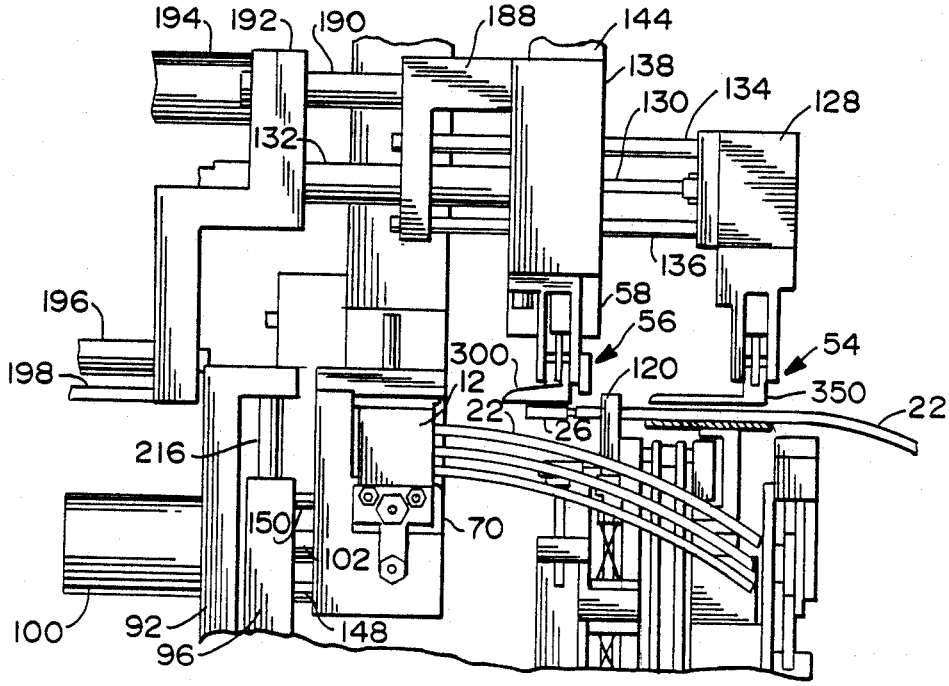
FIGS. 37-43 and 45-50 are elevated side views of illustrating the automated sequence of lead insertion steps performed by the new and improved lead insertion apparatus of the present invention.

Referring now to FIG. 50, lead conveyor 44 is advanced to bring the next clamp 120 and lead 22 into position at the lead pick-up station 46. In the process, an intermediate wire deflecting finger 126 deflects the trailing end of the lead 22 out of the lead pick up station 46 so that it is draped downwardly along side the lead conveyor 44.

In accordance with the present invention, the insertion process is repeated, indexing the connector clamp 70 towards insertion station 42 along a desired path. As the clamp 70 is re-indexed into insertion station 42 forward bottle nose portions of the terminal guide jaws 300 and 302 cooperate with the clamp motion to deflect the trailing ends of the previously inserted wire leads 22 out of interference between the terminal guide jaws 300 and 302 and the new targeted rear opening 18 in the connector housing 12. A broad range of movements can be programmably provided to connector clamp 70 so that the bottle nosed portions of the terminal guide jaws 300 and 302 nudge the trailing ends of previously inserted leads out of the path of the next insertion in and desired manner.

As will be readily understood by those skilled in this art, after a connector housing 12 has been completely filled in any random order using the insertion apparatus 10 of this invention, clamp air cylinder 184 can be actuated to retract clamp member 182 to a release position. Thereafter, the eject air cylinder 380 can be actuated to its extended position so that eject pawls 176 and 178 push the completed harness out of clamp 70 and into harness eject station 62.

In accordance with an important aspect of the preferred embodiment, the overall orchestration or coordinated movement of the various subassemblies of apparatus 10 may be controlled by commercially available programmable controller equipment known to those skilled in this art.

The new and improved insertion apparatus 10 may be utilized in various combinations with other conventional equipment to provide varied and complex crimped wire harnesses. For example, the lead conveyor may comprise a double ended lead conveyor having an opposed pair of releaseable clamps for gripping the trailing end of the terminated wire lead. The opposed end of the wire leads may be terminated by the same or different terminals. A second insertion apparatus 40 may be provided along the opposed lead conveyor path. When used with double ended lead conveyor equipment the new and improved lead insertion apparatus of the present invention may now be used to prepare a complex cross over harness in a fully automated manner through programming the housing index mechanism. The programmable housing index module may be programmed to present the second terminal cavity of the second connector located at the second insertion station independently of what has occurred at the first insertion station. In accordance with this aspect, there is no need for complex wire pick up and rearrangement mechanisms heretofore used in prior art devices for making cross over harnesses. In a similar manner, the manufacture of pitch transition connector harnesses can also be easily accomplished.

Changeover tooling for different terminals and wire gauge sizes simply requires the front terminal guide jaws and the lead insertion jaws to be replaced, as well as, the rear wall of the connector clamp. This changeover can occur very rapidly with very little downtime. Each time a changeover is required the connector indexing module will have to be reprogrammed to define an overall insertion sequence program for completely filling the connector housing with terminated leads. Once the program has been worked out for the first connector housing, the program can be run automatically using the new and improved lead insertion apparatus 40 of this invention to provide a fully automated high volume crimp wire harness fabrication operation.

Further variations in the overall configuration of the appartus may be envisioned by those skilled in the art. In addition to having a second insertion apparatus and a second insertion station for inserting the terminated second ends of terminated leads to form various double ended wire harnesses, one or more additional insertion stations, similarly equipped can be provided on the opposite side of the lead conveyor. In accordance with this further embodiment one end of a plurality of wire leads can be attached in a single large circuit number multicircuit connector and the opposed ends of the leads may be inserted into one or more smaller circuit size connectors as desired. The modifications required to provide these different types of harnesses should generally be familiar to those skilled in the harness fabrication art.

Although the present invention has been described with reference to a preferred embodiment, modifications or changes other than those already mentioned may be made therein by those skilled in this art. For example, instead of using an air cylinder (100, 102) for the Y axis drive mechanism, Y-axis movements of connector clamp 70 may be controlled by a similarly mounted stepper motor with encoder and drive screw arrangement. Instead of using stepper motors with encoders for X, Y and Z drives servo drives may be substituted. In addition, a different method for feeding connector housings one at a time to the connector clamp other than a magazine feed may be used. For example, vibratory bowl delivery line and connector shuttle arm may be used. Instead of using a single ended lead conveyor and the wire tensioning jaw assembly to present a horizontal prestraightened wire segment to the lead insertion jaw assembly, the lead conveyor feed may be double ended to hold a wire segment tautly between a pair of conveyor clamps. All such obvious modifications may be made by those skilled in this art without departing from the scope and spirit of the present invention as defined by the appended claims.

We claim:

1. An apparatus for inserting a terminated wire lead into a terminal-receiving cavity of a multi-circuit connector at an insertion station including:

lead conveyor means including releasable clamp means for conveying terminated wire leads laterally of their axes to a position adjacent the insertion station;

connector indexing means for indexing a multi-circuit connector housing to align one terminal-receiving cavity at a time in position with respect to a terminated wire lead at the insertion station; and lead insertion means including releasable clamp means for gripping the terminated wire lead from the conveyor means and further including drive means for axially advancing the clamp means and gripped wire lead toward the connector housing to fully insert the terminal into the aligned housing cavity, the improvement in said lead insertion means comprising:

said releasable clamp means including a pair of elongate insertion jaws each having a forward tip for longitudinally surrounding and gripping the wire lead;

adjustable control means for actuating said insertion jaws between a first open position, a second intermediate position wherein said insertion jaws are axially slideable along the gripped wire lead and a third closed position wherein said insertion jaws firmly grip the wire lead in a non-slideable manner; and sensing means for sensing when the front tips of said insertion jaws abut the terminal as said drive means advances the insertion jaws in their intermediate position along the wire lead axially toward the insertion station, whereupon the control means changes the position of the insertion jaws from said intermediate to said closed position in response thereto prior to insertion.

2. An apparatus as in claim 1, wherein said adjustable control means includes a mounting member, an air cylinder with a piston rod mounted on said mounting member and a regulator for regulating air pressure delivered to the air cylinder.

3. An apparatus as in claim 2, wherein said elongate insertion jaws are pivotally mounted on the mounting member adjacent said air cylinder and are further pivotally connected through an actuating linkage to said piston rod and air cylinder.

4. An apparatus as in claim 3, wherein said drive means includes an air cylinder with a drive rod having a free end and said adjustable control means is mounted for movement on the free end of said drive rod.

5. An apparatus as in claim 1, further including wire tensioning means for presenting a taut wire segment extending from said lead conveyor releasable clamp means for gripping by said elongate insertion jaws.

6. An apparatus as in claim 1, further including terminal guide means adjacent said insertion station intermediate said lead conveyor means and the insertion station, said terminal guide means including internal bore means adapted to slidably receive the terminated lead and elongate insertion jaws during insertion, said bore means being profiled to control rotational orientation of the terminal during insertion to align the terminal with the terminal receiving cavity at the insertion station.

7. An apparatus as in claim 1, wherein said terminal guide means includes a forward end having a bottle nosed configuration disposed at the insertion station for deflecting a trailing end of a previously inserted wire lead away from the insertion station as the connector indexing means index the housing to align one terminal receiving cavity with respect to a lead at the insertion station.

8. An apparatus as in claim 1 wherein said connector indexing means includes a connector clamp member for releasably holding a connector housing and drive means for reciprocably moving the clamp member along three mutually perpendicular axes with respect to a wire lead at the insertion station to align one terminal receiving cavity of the clamped connector in position with respect to said terminated lead.

9. An apparatus in claim 1 further including clamp opening means for releasing the lead conveyor clamp means as the drive means axially advances the insertion jaws in their intermediate position along the wire lead toward the insertion station.

* * * * *